US005459020A

United States Patent [19]

Sato

[11] Patent Number: 5,459,020

[45] Date of Patent: Oct. 17, 1995

[54] SILVER HALIDE COLOR PHOTOGRAPHIC MATERIALS

[75] Inventor: Takehiko Sato, Kanagawa, Japan

[73] Assignee: Fuji Photo Film Co., Ltd., Kanagawa, Japan

[21] Appl. No.: 163,703

[22] Filed: Dec. 9, 1993

[30] Foreign Application Priority Data

Dec. 11, 1992 [JP] Japan ..... 4-352350

[51] Int. Cl.[6] ..... G03C 1/46

[52] U.S. Cl. ..... 430/503; 430/505; 430/523; 430/531; 430/533; 430/538; 430/548; 430/551; 430/558

[58] Field of Search ..... 430/538, 533, 430/531, 523, 505, 551, 503, 546–558

[56] References Cited

U.S. PATENT DOCUMENTS 3,061,432 10/1962 Menzel et al. ..... 430/558
4,500,630 2/1985 Sato et al. ..... 430/551
5,122,444 6/1992 Sakai ..... 430/505
5,212,055 5/1993 Morigaki et al. ..... 430/551

FOREIGN PATENT DOCUMENTS 0298321 1/1989 European Pat. Off. .
0507489 10/1992 European Pat. Off. .

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

Silver halide color photographic materials are described in which anti-fading agents and anti-staining agents are included in silver halide emulsion layers which contain pyrazoloazole-based couplers which have been established by coating on a reflective supports, the base material of which is covered with a composition in which a white pigment has been admixed with, and dispersed in, a resin of which polyester forms the principal component.

21 Claims, No Drawings

SILVER HALIDE COLOR PHOTOGRAPHIC MATERIALS

FIELD OF THE INVENTION

This invention concerns silver halide color photographic materials in which a reflective support is used, and especially color printing papers which have excellent color reproduction and colored image storage properties, and which have excellent resistance to staining in the non-image parts.

BACKGROUND OF THE INVENTION

With the dissemination of silver halide photographic materials in recent years, a powerful demand has arisen for silver halide color photographic materials which have excellent color reproduction and image storage properties when compared with other image forming systems.

The method of colored image formation most generally used in silver halide color photographic materials is that in which the exposed silver halide functions as an oxidizing agent, the oxidized aromatic primary-amine based color developing agent reacts with couplers, and indophenol, indoaniline, indamine, azomethine, phenoxazine or phenazine-based dyes or corresponding dyes are formed. In such a system, the method of reproducing a colored image by means of the subtractive color method is used and, in general, the colored image is formed by varying the amounts of dyes of the three colors yellow, magenta and cyan which are formed.

The 5-pyrazolone azomethine-type magenta couplers and pyrazoloazole-type couplers are known as magenta couplers in such systems. Brilliant dyes with little subsidiary absorbance are needed to obtain color photographic images which have good color reproduction and, in particular, the dyes obtained from the pyrazoloazole type magenta couplers disclosed in U.S. Pat. Nos. 3,061,432 and 4,500,630, for example, are more effective as dyes which are obtained from magenta couplers than the 5-pyrazolone azomethine dyes which have subsidiary absorbance in the 400–450 nm region.

However, the light fastness may be adversely affected when these pyrazoloazole-based magenta couplers are used in a silver halide color photographic material, and there is a problem in that magenta colored staining occurs on prolonged storage after development processing.

When such staining occurs, the quality of the photographic image is markedly reduced, and thus various attempts at improvement have been made.

It has been reported in European Patent EP 0,298,321 that the conjoint use of anti-fading agents which have a specified structure and anti-color staining agents provides some improvement with respect to the above-mentioned problem. Here, the anti-color staining agent is a compound which bonds chemically with the aromatic amine-based developing agent or the oxidized form of the aromatic amine-based developing agent which remains in the photographic material after development processing and produces essentially colorless products. Moreover, in JP-A-3-48845 (corresponding to U.S. Pat. No. 5,212,055), it is indicated that light fading in all regions from the high density parts to the low density parts of the magenta image is improved by using a combination of anti-fading agents of a number of types. (The term "JP-A" as used herein signifies an "unexamined published Japanese patent application".)

It is possible to improve the storage properties of the magenta dye image by using these techniques, but it has not been possible to eliminate completely the occurrence of color staining with the above-mentioned pyrazoloazole-based magenta couplers, and further improvement is desirable.

SUMMARY OF THE INVENTION

An aim of this present invention is to provide silver halide color photographic materials in which the colored dyes have excellent spectral absorption characteristics, which provide good color reproduction and which are markedly improved with respect to image fastness and color staining.

As a result of various investigations, the inventors have found that the aforementioned aim can be realized by means of the silver halide photographic materials and the methods of image formation indicated below.

(1) A silver halide color photographic material comprising a reflective support having thereon a yellow coupler-containing silver halide emulsion layer, a magenta coupler-containing silver halide emulsion layer, a cyan coupler-containing silver halide emulsion layer, and a light-insensitive hydrophilic colloid layer, wherein the yellow coupler-containing silver halide emulsion layer, the magenta coupler-containing silver halide emulsion layer, and the cyan coupler-containing silver halide emulsion layer have different color sensitivities from each other and are all coated on the same side of the support, wherein on at least the side of the support on which the emulsion layers are coated, the surface of the support is coated with a composition prepared by mixing and dispersing a white pigment in a resin comprising mainly polyester synthesized by the polycondensation of a dicarboxylic acid and a diol, and at least one of the silver halide emulsion layers contains at least one coupler represented by formula (I), at least one compound represented by formula (III), (IV), (V) or (VI), and at least one compound represented by formula (VII) or (VIII):

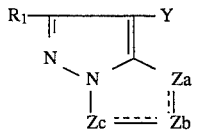

(I)

wherein $R_1$ represents a hydrogen atom or a substituent group, $Z_a$, $Z_b$ and $Z_c$ each independently represent methine, substituted methine, =N— or —NH—, and Y represents a hydrogen atom or a group capable of splitting off upon a coupling reaction with an oxidation product of a developing agent, and dimers and polymers including oligomers may be formed with $Z_a$, $Z_b$ or $Z_c$ representing substituted methine or with $R_1$ or Y;

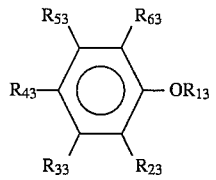

(III)

wherein $R_{13}$ represents a hydrogen atom, an alkyl group, an aryl group or a heterocyclic group, $R_{23}$, $R_{33}$, $R_{53}$ and $R_{63}$ each independently represent a hydrogen atom, a hydroxy group, and alkyl group, an aryl group or an alkoxy group, $R_{43}$ represents an alkyl group, a hydroxy group, an aryl group or an alkoxy group, and $R_{13}$ and $R_{23}$ may be joined together to form a five- or six-membered ring, or $R_{33}$ and $R_{43}$ may be joined together to form a five-membered hydrocarbyl ring;

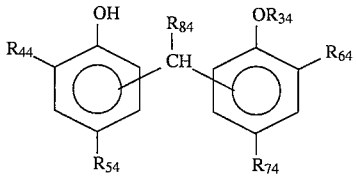

(IV)

wherein $R_{34}$ represents a hydrogen atom, an alkyl group, an acyl group, an aryl group or an alkenyl group, $R_{44}$, $R_{54}$, $R_{64}$ and $R_{74}$ each independently represent an alkyl group having 1 to 12 carbon atoms, $R_{84}$ represents a hydrogen atom or an alkyl group having 1 to 20 carbon atoms, the methine group which connects the two benzene rings connects the rings at the positions ortho or para to the oxygen atoms on the respective rings, and when connected in the para positions, $R_{54}$ or $R_{74}$ represents the connecting methine group itself, and in this case there can be further alkyl groups on the benzene rings;

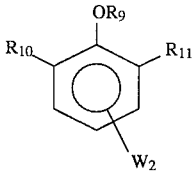

(V)

wherein $R_9$ represents a hydrogen atom, an alkyl group, an aryl group or an acyl group, $R_{10}$ and $R_{11}$ each independently represent a substituted or unsubstituted alkyl group or alkoxy group, and $W_2$ represents a monovalent group which can be substituted on a benzene ring;

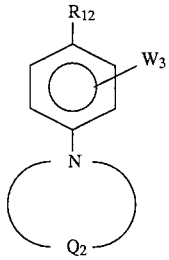

(VI)

wherein $Q_2$ is a divalent group which, together with alkylene groups and the nitrogen atom, forms a five- to seven-membered ring, with $Q_2$ representing a —$CH_2$—, —O—, —NR'—, —S—, —SO—, —$SO_2$—, —PR'— or —PO(R')—group, wherein R' represents an alkyl group, $R_{12}$ represents an alkyl group, an alkoxy group, an aryloxy group or an acyloxy group, and $W_3$ represents a monovalent group which can be substituted on a benzene ring;

$$R_{21}—(A)_n—X \quad \text{(VII)}$$

wherein $R_{21}$ represents an aliphatic group, an aromatic group or a heterocyclic group, X represents a group which is eliminated on reaction with an aromatic amine developing agent, A represents a group which reacts with an aromatic amine developing agent and forms a chemical bond, and n represents 0 or 1;

$$R_{30}—Z \quad \text{(VIII)}$$

wherein $R_{30}$ represents an aliphatic group, an aromatic group or a heterocyclic group, and Z represents a nucleophilic group or a group which breaks down in the photographic material and releases a nucleophilic group.

(2) A silver halide color photographic material as in (1) above, wherein the polyester of the reflective support comprises mainly polyethylene terephthalate.

(3) A silver halide color photographic material as in (1) above, wherein the polyester of the reflective support is a polyester prepared by the polycondensation of a dicarboxylic acid and a diol, and the dicarboxylic acid component is a mixture of terephthalic acid and isophthalic acid.

(4) A silver halide color photographic material as in (1) above, wherein the polyester of the reflective support is a polyester prepared by the polycondensation of a dicarboxylic acid and a diol, and the dicarboxylic acid component is a mixture of terephthalic acid and naphthalenedicarboxylic acid.

(5) A silver halide color photographic material as in (3) or (4) above, wherein the diol is ethylene glycol.

(6) A silver halide color photographic material as in (1), (2), (3), (4) or (5) above, wherein the white pigment of the reflective support is titanium oxide and the weight ratio of titanium oxide to the resin comprising mainly polyester is from 5/95 (titanium oxide/resin) to 50/50.

(7) A silver halide color photographic material as in (1), (2), (3), (4), (5) or (6) above, wherein the coupler of formula (I) is a 1H-imidazo[1,2-b]pyrazole, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

Moreover, when using the photographic materials of (1)–(7), there is a marked improvement with respect to the loss of photographic speed when the product is stored with a system in which it is exposed using a scanning exposure system in which the exposure time per picture element is shorter than $10^{-4}$ second and then subjected to color development processing.

Furthermore, and unexpectedly, the increase in the magenta color component which is produced on storing a yellow image of the silver halide photographic material under conditions of high temperature and high humidity is suppressed, and the yellow image storage properties are also improved appreciably.

The reflective support for which at least the side of the base material on which the emulsion is coated is covered with a composition in which a white pigment is admixed with, and dispersed in, a resin which comprises mainly polyester of the present invention has been disclosed in European Patent Laid Open 507,489. However, although it is disclosed in the European specification that performance characteristics such as the smoothness of the support and the gloss are improved by changing the resin which covers the support from polyolefin to polyester for the principal component, there is no disclosure concerning photographic materials which are prepared using this support, and the improving effect on the image storage properties which is obtained in the embodiment of the present invention could not be anticipated.

DETAILED DESCRIPTION OF THE INVENTION

The present invention is described in detail below.

In the present application, the term "X comprising mainly Y" signifies that the proportion of Y in X is at least 50 percent by weight.

The reflective support in the present invention must be a reflective support of which at least the side of the base material on which the emulsion is coated is covered with a composition in which a white pigment is admixed with, and dispersed in, a resin of which polyester is the principal component.

The polyester is a polyester which has been synthesized by condensation from dicarboxylic acid and diol, and terephthalic acid, isophthalic acid and naphthalene dicarboxylic acid, for example, can be cited as preferred dicarboxylic acids. Examples of preferred diols include ethylene glycol, butylene glycol, neopentyl glycol, triethylene glycol, butanediol, hexylene glycol, bisphenol A ethylene oxide adduct (2,2-bis(4-2-hydroxyethyloxy)phenyl)propane and 1,4-dihydroxymethylcyclohexane.

Various polyesters which have been obtained by condensing these dicarboxylic acids individually, or in the form of mixtures, with the polyols individually, or in the form of mixtures, can be used in the case of the present invention. Those in which at least one of the dicarboxylic acids is terephthalic acid are preferred. Furthermore, mixtures of terephthalic acid and isophthalic acid (mol ratio 9:1–2:8) or mixtures of terephthalic acid and naphthalene dicarboxylic acid (mol ratio 9:1–2:8) can also be used preferably as the dicarboxylic acid component. Furthermore, the use of ethylene glycol or a mixed diol which contains ethylene glycol is preferred for the diol. The molecular weight of these polymers is preferably about 30,000 to about 50,000.

The use of polyesters of different compositions as complex mixtures is also desirable. Moreover, use of mixtures of these polyesters with other resins is also desirable. Other resins which can be admixed can be selected from a wide range provided that the resin can be extruded at 270°–350° C., and they include, for example, polyolefins such as polyethylene and polypropylene, polyethers such as polyethyleneglycol, polyoxymethylene and polyoxypropylene, polyester-based polyurethanes, polyether polyurethanes, polycarbonates and polystyrene. The blended resin may of one type, or a mixture of two or more types may be used. For example, 6 percent by weight of polyethylene and 4 percent by weight of polypropylene can be admixed with 90 percent by weight of polyethylene terephthalate. The mixing ratio of the other resin with the polyester differs according to the type of resin which is being admixed, but with polyolefins proportions by weight of polyester/other resin of 100/0–80/20 are appropriate. If this range is exceeded, the properties of the mixed resin are greatly reduced. In the case of resins other than the polyolefins, the resin can be mixed in the range as a ratio by weight of polyester/other resin of 100/0–50/50. The effect of the invention is not realized satisfactorily in cases where the amount of polyester is less than 50 percent by weight.

Inorganic pigments such as titanium oxide, barium sulfate, lithophone, aluminum oxide, calcium carbonate, silicon oxide, antimony trioxide, titanium phosphate, zinc oxide, white lead and zirconium oxide, and fine organic powders such as polystyrene and styrene-divinylbenzene copolymer powders, for example, can be cited as white pigments which can be admixed with, and dispersed in, the polyester of a reflective support of the present invention.

From among these pigments, the use of titanium dioxide is especially effective. The titanium dioxide may be in either the rutile form or the anatase form, and it may have been prepared using either the sulfate method or the chloride method. Titan Kogyo K.K. KA-10 and KA-20, and Ishihara Sangyo Kaisha, Ltd. A-220, for example, can be cited as actual trade names.

The average particle size of the white pigment which is used is preferably 0.1–0.8 μm. If it is less than 0.1 μm, it is difficult to achieve uniform mixing with, and dispersion in, the resin, and this is undesirable. If it exceeds 0.8 μm, an adequate degree of whiteness is generally not obtained and, furthermore, protrusion from the covered surface occurs, and there is generally an adverse effect on image quality.

The mixing ratio of the white pigment with respect to the above-mentioned polyester is, as a ratio by weight, 98/2–30/70 (polyester/white pigment), preferably 95/5–50/50, and most desirably 90/10–60/40. With less than 2 percent by weight of white pigment, there is generally an inadequate contribution to the degree of whiteness, and if the amount exceeds 70 percent by weight the surface smoothness is generally inadequate when used as a photographic printing paper support, and it is generally impossible to obtain a photographic printing paper support which has an excellent gloss.

Moreover, the mixing of the white pigment with the above-mentioned resin is preferably carried out by milling into the resin together with a dispersing aid such as a higher fatty acid metal salt, a higher fatty acid ester, a higher fatty acid amide or a higher fatty acid using a mixer such as a double roll, a triple roll, a kneader or a Banbury mixer. Antioxidants may also be included in the resin layer, and the amount compounded is 50–1000 ppm with respect to the resin.

The thickness of the polyester/white pigment composition which covers the side of the base material of a reflective support of this present invention on which the emulsion is coated is generally 5–100 μm, preferably 5–80 μm, and most desirably 10–50 μm. If it exceeds 100 μm, there generally are problems with the properties in that, for example, the brittleness of the resin is emphasized and cracking occurs. If it is thinner than 5 μm, the water repelling action which is the principal aim of the covering generally is lost and, moreover, the surface smoothness of the degree of whiteness generally becomes unsatisfactory at the same time, the covering generally becomes physically weak, and such is generally undesirable.

The resin or resin composition which covers the surface of the base material on which the emulsion is not coated preferably comprises mainly polyester resin, and especially polyethylene terephthalate resin, as the principal component, and it is preferably of a thickness 5–100 μm, and most desirably of a thickness 10–50 μm. If the thickness exceeds this range, there generally are problems with the properties in that, for example, the brittleness of the resin is enhanced and cracks are formed. If it is below this range, the water repelling action which is the principal aim of the covering generally is lost and, moreover, the covering generally becomes physically weak, and such is generally undesirable.

The melt extrusion lamination method, for example, can be cited as a method of covering the base material with the reverse layer and the covering layer on the side on which the emulsion is coated.

The base material which is used for a reflective support of the present invention is selected from among the materials generally used for photographic printing papers. That is to say, base papers in which a natural pulp selected from coniferous tree and broad leaf tree pulps is used as the main ingredient with the addition, as required, of fillers such as clay, talc, calcium carbonate and fine particles of urea resin, sizing agents such as rosin, alkylketene dimers, higher fatty acids, epoxidized fatty acid amides, paraffin wax and alkenylsuccinic acid, paper reinforcing agents such as starch, polyamide polyamine epichlorhydrin and polyacrylamide, and fixing agents such as aluminum sulfate and cationic polymers, for example, are preferably used.

No particular limitation is imposed upon the type or thickness of the base material, but a weight of 50 g/m$^2$–250 g/m$^2$ is desirable. The base material is preferably surface treated with the application of heat and pressure by machine calendering or super calendering, for example, in order to provide surface smoothness and flatness.

The "smoothness" is represented with the surface roughness of the support as a measure.

The surface roughness of a support of the present invention is described below.

The center line average surface roughness is used as a measure of the surface roughness. The center line average surface roughness is defined in the following way. The part of area SM (i.e., 5 mm$^2$) is extracted on the center plane from the roughness curve plane, the linear coordinate axes (the X-axis and the Y-axis) are set on the center line of the extracted part, the axis which is at right angles to the center line is taken as the Z-axis, and then the value obtained using the following equation is defined as the center line average surface roughness ($SR_a$), and it is represented in units of μm.

$$SR_a = \frac{1}{SM} \int_0^{L_X} \int_0^{L_Y} |f(1X, Y)| \, dX \cdot dY$$

$$L_X \, L_Y = SM$$
$$Z = f(X, Y)$$

The center line average surface roughness and the value of the height of the protrusions from the center line can be obtained using a three dimensional surface roughness measuring machine (SE-30H) made by Kosaka Laboratories (Co.), for example, and measuring an area of 5 mm$^2$ at a magnification in the height direction of 2000 times with a horizontal direction magnification of 20 times and a cut off value of 0.8 mm with a diamond needle of a diameter 4 μm. Furthermore, the speed of the measuring needle at this time is preferably of the order of 0.5 mm/second.

The value obtained by measurement is not greater than 0.15 μm with a preferred support, and most desirably not greater than 0.10 μm. Color prints which have excellent surface smoothness are obtained by using a support which has such a surface roughness (smoothness).

The surface of the base is preferably pre-treated with a corona discharge treatment, a flame treatment or undercoating, for example, when covering a base paper with the above-mentioned mixed composition of polyester and white pigment.

When a polyester such as polyethylene terephthalate is used, the adhesion with a photographic emulsion is weaker than in the case of polyethylene, and thus the polyester surface is preferably subjected to a corona discharge treatment and a hydrophilic colloid layer is established by coating after the melt extrusion lamination of the polyester on the base paper.

Furthermore, coating with an undercoating liquid which contains a compound which can be represented by the general formula (U) on the thermoplastic resin surface of which polyester forms the principal component is also desirable.

General Formula (U)

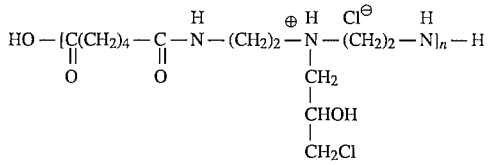

Where n is an integer of value 1–7

The amount of compound represented by general formula (U) which can be coated is preferably at least 0.1 mg/m$^2$, more desirably at least 1 mg/m$^2$, and most desirably at least 3 mg/m$^2$, and the strength of adhesion is increased as the amount is increased, but there is a cost disadvantage if an excess is used.

Furthermore, alcohols such as ethanol are preferably added in order to improve the compatibility of the undercoating liquid with the resin surface. In this case, the proportion of alcohol is preferably at least 20 percent by weight, more desirably at least 40 percent by weight, and most desirably at least 60 percent by weight. Furthermore, the use of various types of surfactants, such as anionic, cationic, amphoteric, non-ionic, fluorocarbon-based and organosilicon-based surfactants, is desirable for improving the suitability for coating.

The addition of a water soluble macromolecular material such as gelatin is desirable for obtaining a good undercoated surface.

The pH of the liquid is preferably from pH 4 to pH 11, and most desirably from pH 5 to pH 10, in consideration of the stability of the compound of general formula (U).

The thermoplastic resin surface is preferably subjected to a surface treatment before coating the above-mentioned undercoating liquid. A corona discharge treatment, a flame treatment or a plasma treatment, for example, can be used as a surface treatment.

Coating using the generally well known methods of coating, such as with a gravure coater or a bar coater, the dip coating method, the air knife coating method, the curtain coating method, the roller coating method, the doctor coating method or the extrusion coating method can be used for coating the undercoating liquid.

The drying temperature of the coating is preferably 30° C.–100° C., more desirably 50° C.–100° C., and most desirably 70° C.–100° C., and the upper limit is determined by the heat resistance of the resin and the lower limit by the production efficiency.

Next, the compounds which can be represented by general formula (I) will be described in detail.

Of the couplers which can be represented by general formula (I), the 1H-imidazo[1,2-b]pyrazoles, the 1H-pyrazolo-[1,5-b]pyrazoles, the 1H-pyrazolo[5,1-c][1,2,4]triazoles, the 1H-pyrazolo[1,5-b][1,2,4]triazoles and the 1H-pyrazolo[1,5-d]tetrazoles are preferred, and these can be represented by the general formulae (IIa), (IIb), (IIc), (IId) and (IIe), respectively.

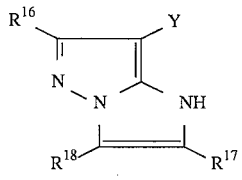

(IIa)

-continued

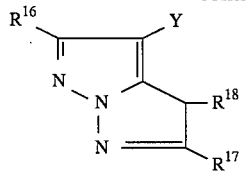

(IIb)

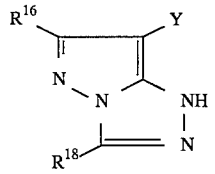

(IIc)

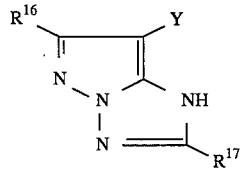

(IId)

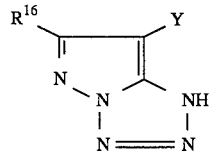

(IIe)

The substituent groups in the general formulae (IIa)–(IIe) are described in detail below. $R_{16}$, $R_{17}$ and $R_{18}$ represent aliphatic groups, aromatic groups or heterocyclic groups, and these groups may be substituted with groups selected from among the alkyl groups, aryl groups, heterocyclic groups, alkoxy groups (for example, methoxy, 2-methoxyethoxy), aryloxy groups (for example, 2,4-di-tert-amylphenoxy, 2-chlorophenoxy, 4-cyanophenoxy), alkenyloxy groups (for example, 2-propenyloxy), acyl groups (for example, acetyl, benzoyl), ester groups (for example, butoxycarbonyl, phenoxycarbonyl, acetoxy, benzoyloxy, butoxysulfonyl, toluenesulfonyloxy), amido groups (for example, acetylamino, methanesulfonamido, dipropylsulfamoylamino), carbamoyl groups (for example, dimethylcarbamoyl, ethylcarbamoyl), sulfamoyl groups (for example, butylsulfamoyl), imido groups (for example, succinimido, hydantoinyl), ureido groups (for example, phenylureido, dimethylureido), aliphatic or aromatic sulfonyl groups (for example, methanesulfonyl, phenylsulfonyl), aliphatic or aromatic thio groups (for example, ethylthio, phenylthio), hydroxy groups, cyano groups, carboxyl groups, nitro groups, sulfo groups, and halogen atoms. $R_{16}$, $R_{17}$ and $R_{18}$ may also be RO—, RC(=O)—, RC(=O)O—, RS—, RSO—, $RSO_2$—, $RSO_2NH$—, RC(=O)NH—, RNH—, ROC(=O)NH—, hydrogen atoms, halogen atoms, cyano groups or imido groups. (R represents an alkyl group, an aryl group or a heterocyclic group).

$R_{16}$, $R_{17}$ and $R_{18}$ may also be carbamoyl groups, sulfamoyl groups, ureido groups or sulfamoylamino groups, and the nitrogen atoms of these groups may be substituted with the substituent groups permitted for $R_{16}$–$R_{18}$. Of these, the alkyl groups, branched alkyl groups, aryl groups, alkoxy groups, aryloxy groups and ureido groups are preferred.

It is preferred that at least one of $R_{16}$, $R_{17}$ and $R_{18}$, particularly $R_{16}$, is a branched alkyl group. As the branched alkyl group, t-butyl group is preferred.

When Y represents a group which can be eliminated in a coupling reaction with the oxidized form of a developing agent (referred to hereinafter as a coupling leaving group), the coupling leaving group is a group such that an aliphatic group, an aromatic group or a heterocyclic group, an aliphatic, aromatic or heterocyclic sulfonyl group or an aliphatic, aromatic or heterocyclic carbonyl group is bonded with the coupling active carbon atom via an oxygen, nitrogen or sulfur atom, a halogen atom or an aromatic azo group, and the aliphatic, aromatic and heterocyclic groups which are included in the coupling leaving groups may be substituted with the substituent groups permitted for $R_{16}$–$R_{18}$.

Actual examples of coupling leaving groups include halogen atoms (for example, fluorine, chlorine, bromine), alkoxy groups (for example, ethoxy, dodecyloxy, methoxyethoxy, methoxyethylcarbonyl, carboxypropyloxy, methylsulfonylethoxy), aryloxy groups (for example, 4-chlorophenoxy, 4-methoxyphenoxy, 4-carboxyphenoxy), acyloxy groups (for example, acetoxy, tetradecanoyloxy, benzoyloxy), aliphatic or aromatic sulfonyloxy groups (for example, methanesulfonyloxy, toluenesulfonyloxy), acylamino groups (for example, dichloroacetylamino, heptafluorobutylamino), aliphatic or aromatic sulfonamido groups (for example, methanesulfonamido, p-toluenesulfonamido), alkoxycarbonyloxy groups (for example, ethoxycarbonyloxy, benzyloxycarbonyloxy), aryloxycarbonyloxy groups (for example, phenoxycarbonyloxy), aliphatic, aromatic or heterocyclic thio groups (for example, ethylthio, phenylthio, tetrazolylthio), carbamoylamino groups (for example, N-methylcarbamoylamino groups, N-phenylcarbamoylamino), five or six-membered nitrogen containing heterocyclic groups (for example, imidazolyl, pyrazolyl, triazolyl, tetrazolyl, 1,2-dihydro-2-oxy-1-pyridyl), imido groups (for example, succinimido, hydantoinyl) and aromatic azo groups (for example, phenylazo). The coupling leaving group in the present invention may contain a photographically useful group such as a development inhibitor, a development accelerator or a silver removal promotor. From among these groups, the halogen atoms and the arylthio groups are especially desirable.

It is especially desirable that $R_{16}$, $R_{17}$ or $R_{18}$ in general formula (IIa), (IIb), (IIc), (IId) and (IIe) should be a branched alkyl group (which may also be substituted) or an aryl group.

Actual examples of general formula (I) are indicated below, but the invention is not limited thereto.

(I-1)
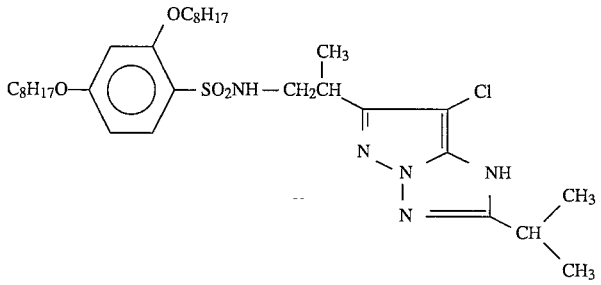
(I-2)
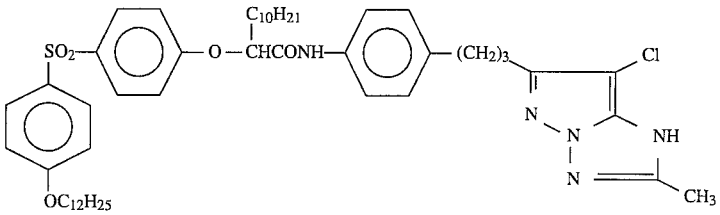
(I-3)
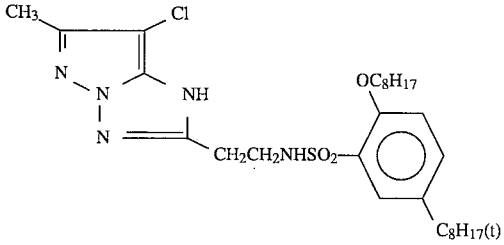
(I-4)
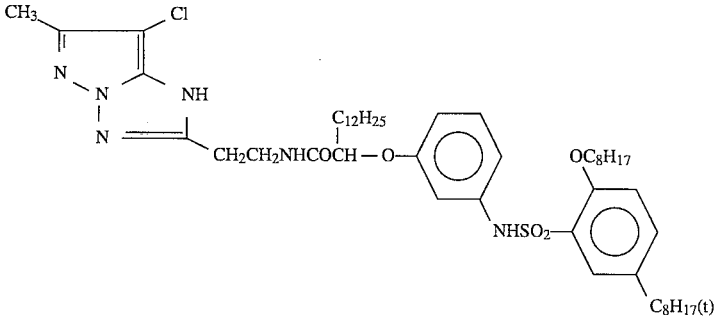
(I-5)
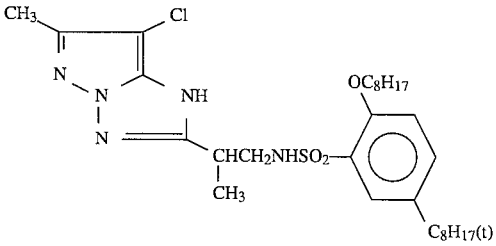
(I-6)
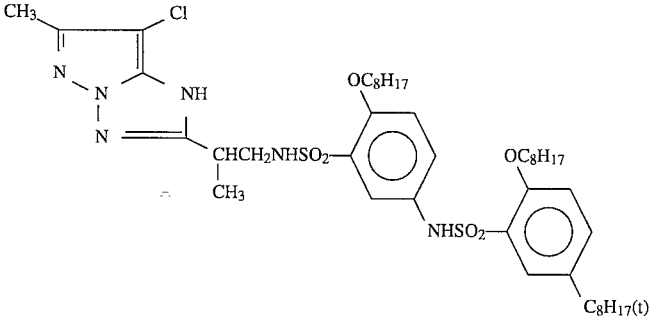

-continued
(I-7)
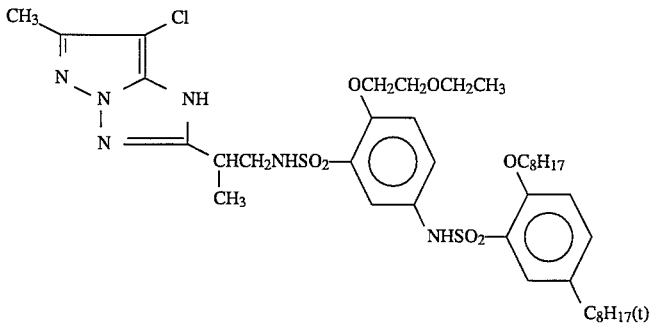
(I-8)
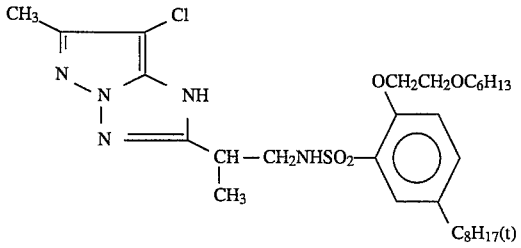
(I-9)
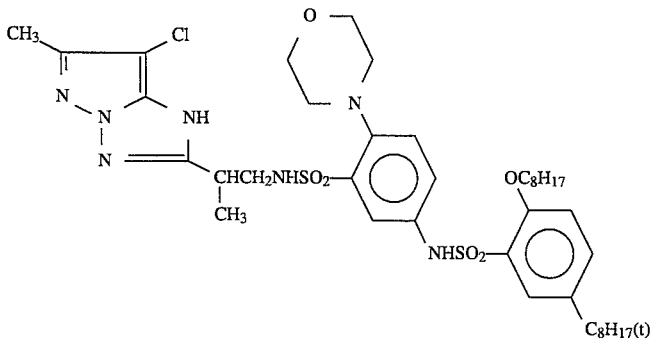
(I-10)
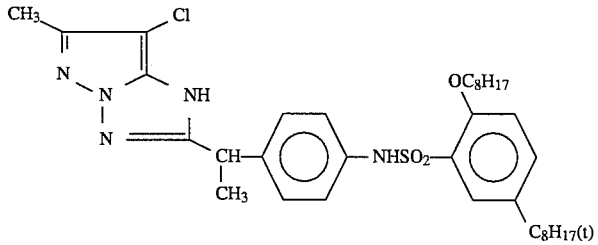
(I-11)
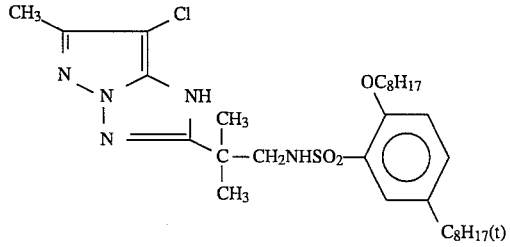
(I-12)
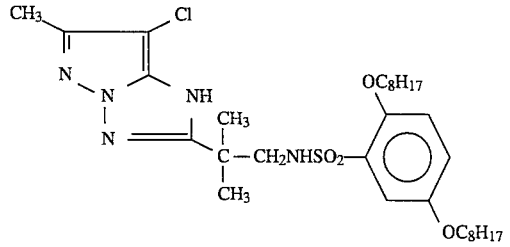

-continued
(I-13)
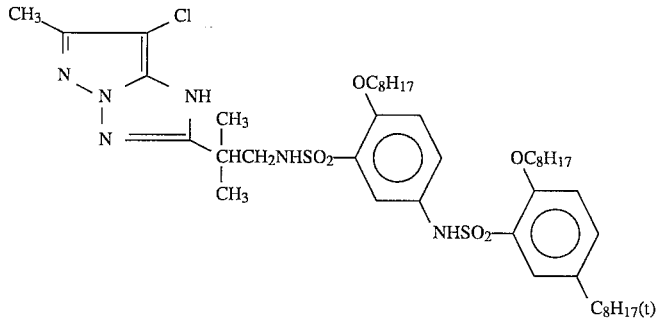
(I-14)
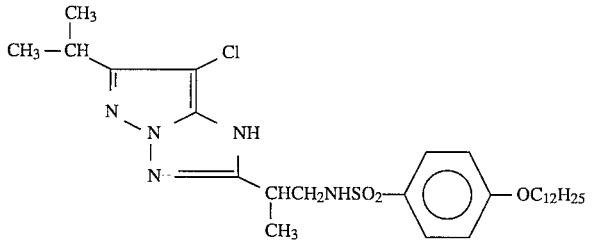
(I-15)
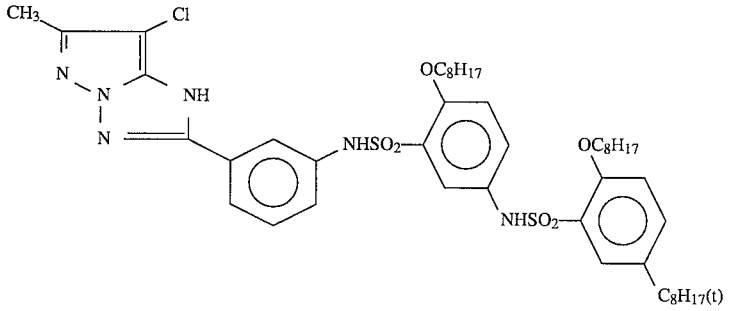
(I-16)
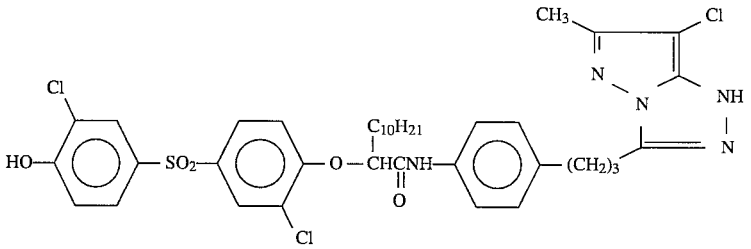
(I-17)
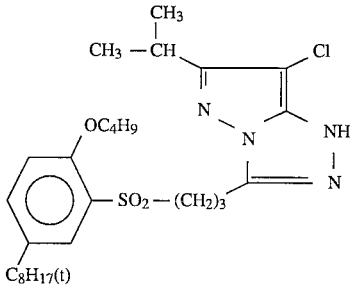

-continued
(I-18)
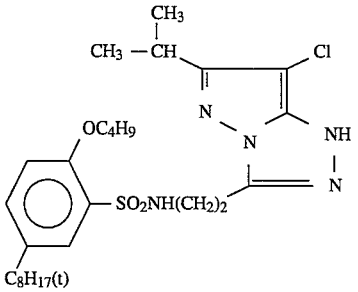
(I-19)
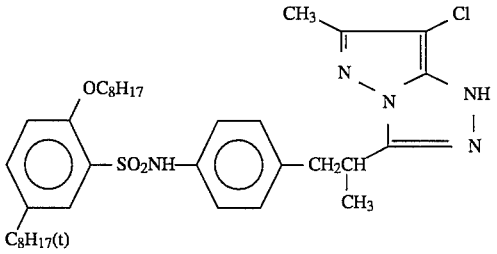
(I-20)
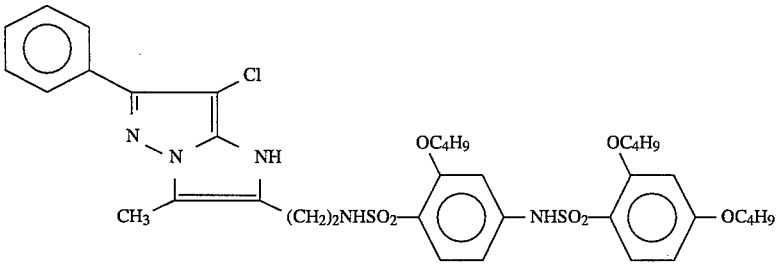
(I-21)
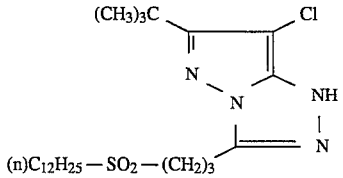
(I-22)
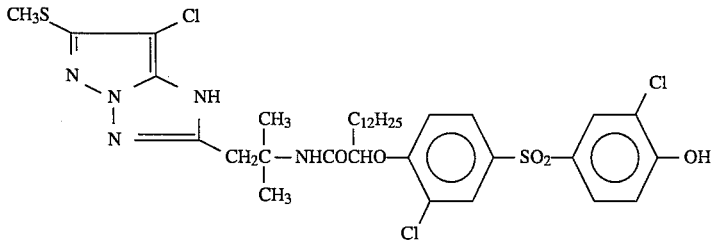
(I-23)
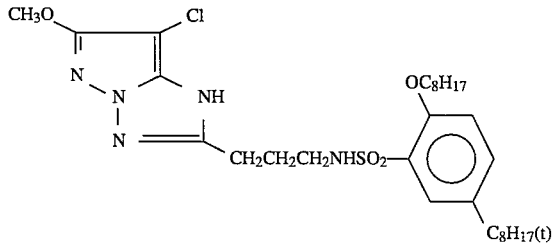

-continued
(I-24)
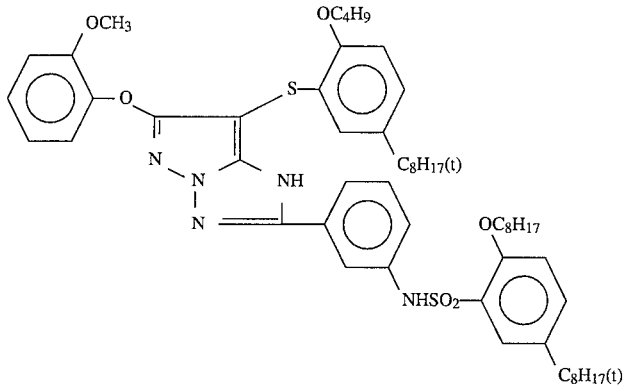
(I-25)
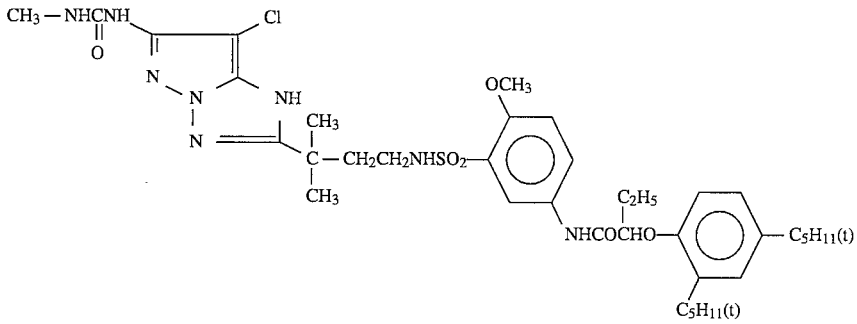
(I-26)
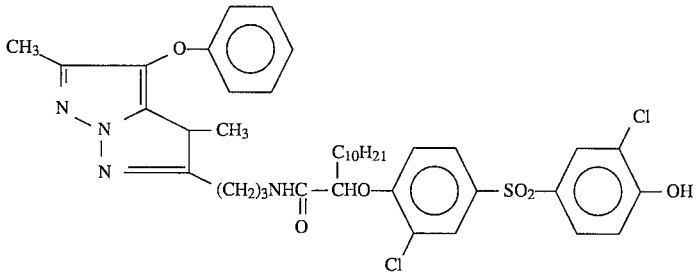
(I-27)
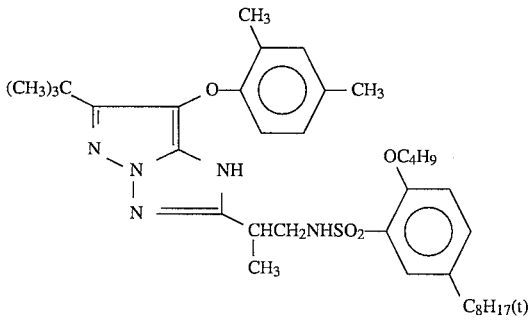
(I-28)
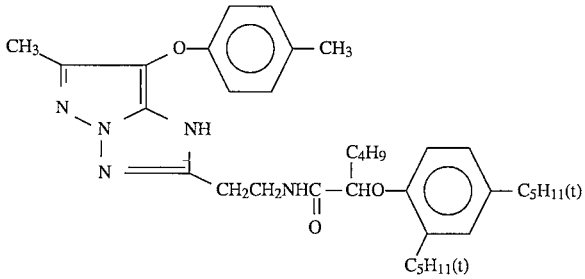

-continued
(I-29)
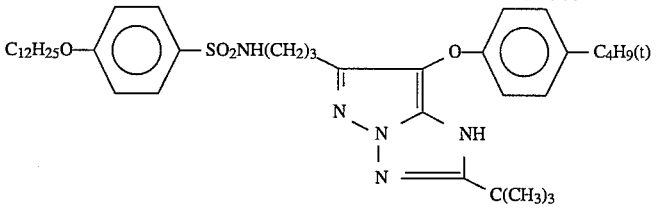
(I-30)
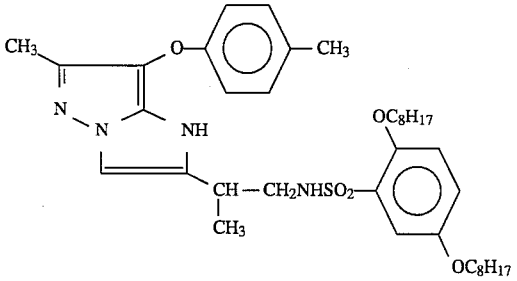
(I-31)
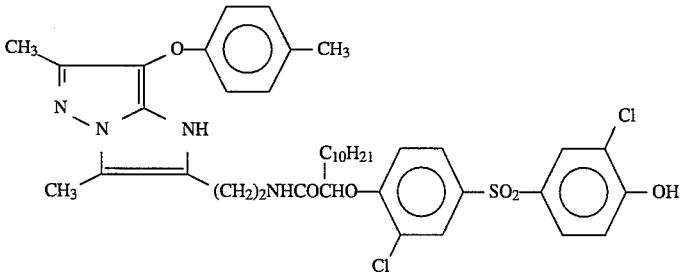
(I-32)
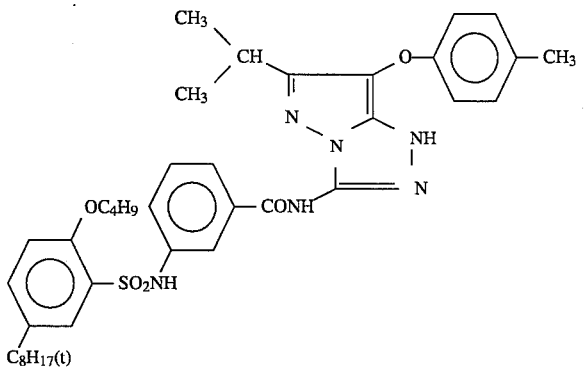
(I-33)
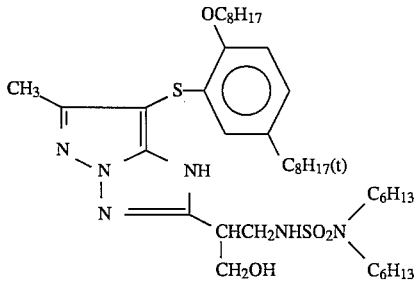

-continued
(I-34)
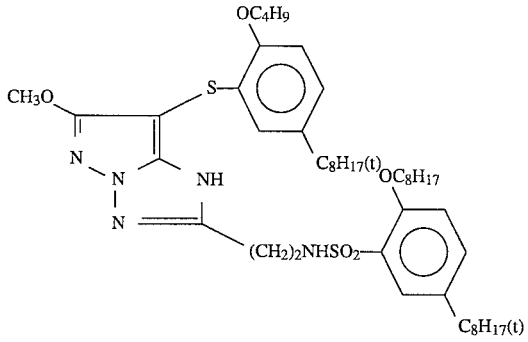
(I-35)
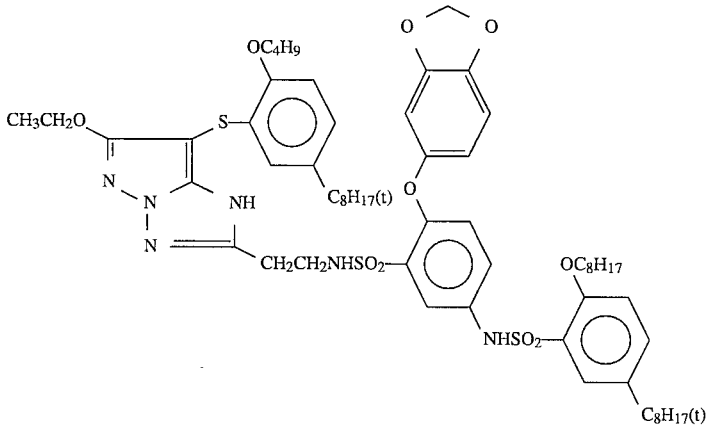
(I-36)
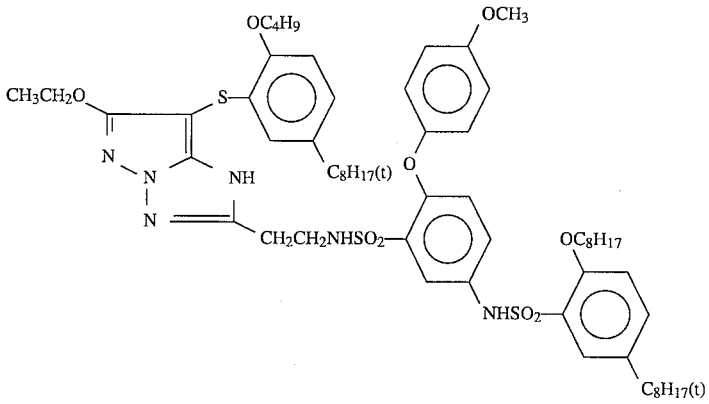
(I-37)
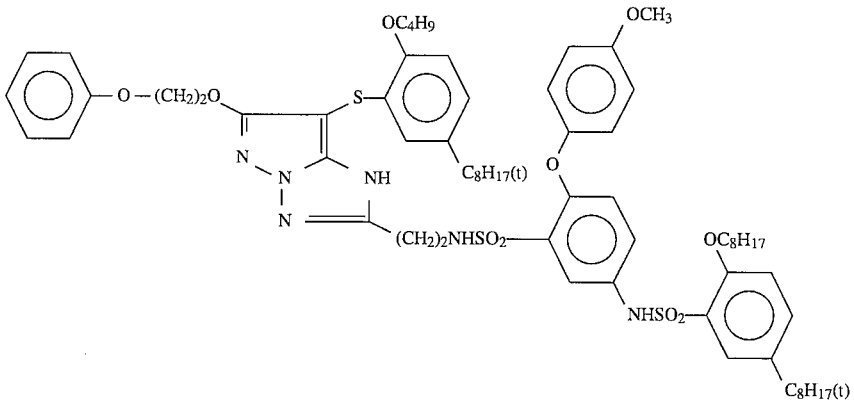

-continued
(I-38)
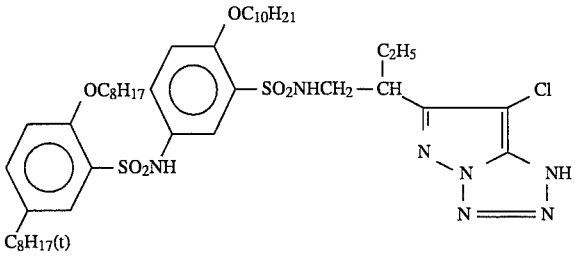
(I-39)
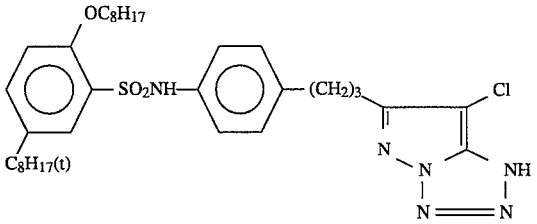
(I-40)
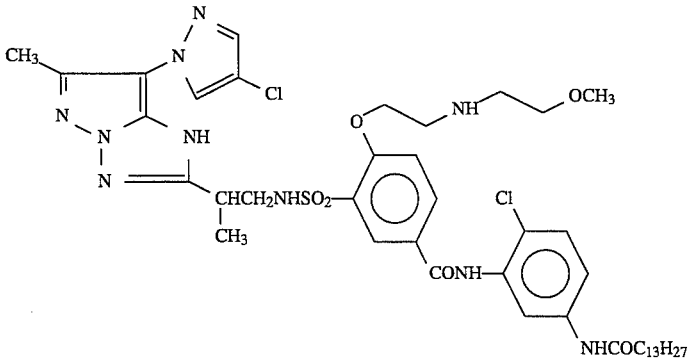
(I-41)
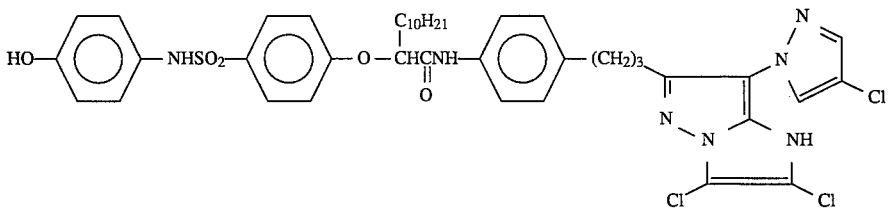
(I-42)
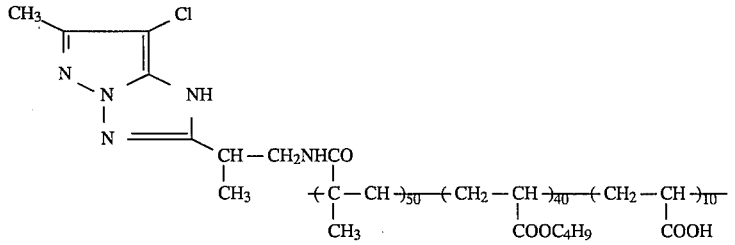
(I-43)
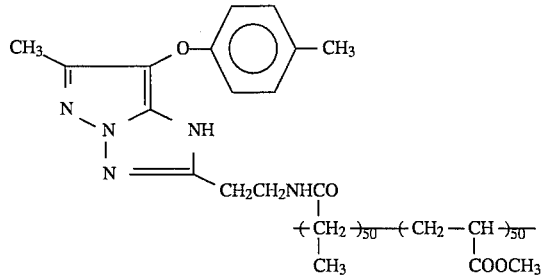

-continued
(I-44)
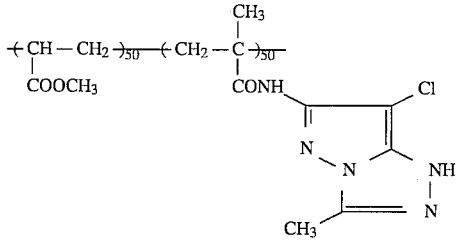
(I-45)
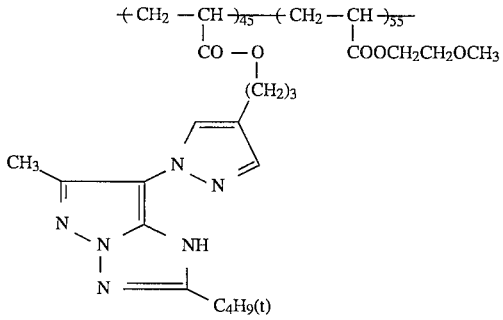
(I-46)
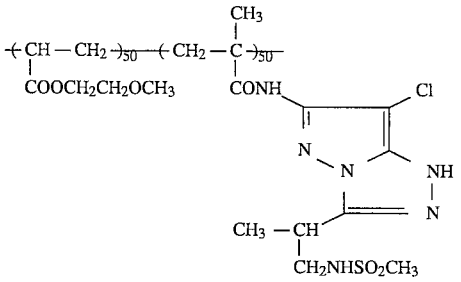
(I-47)
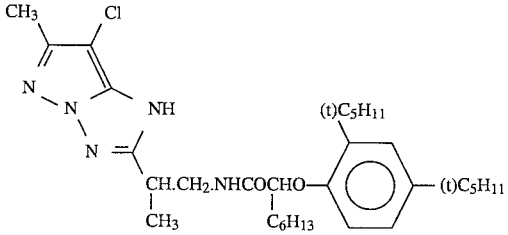
(I-48)
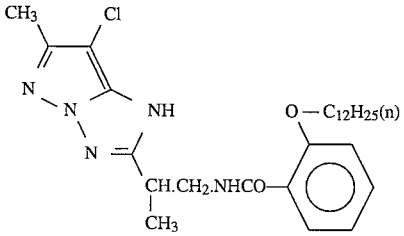
(I-49)
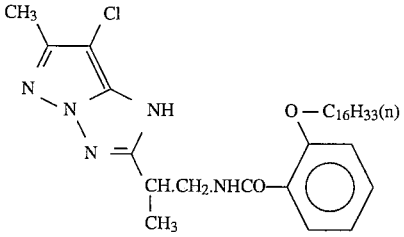

-continued

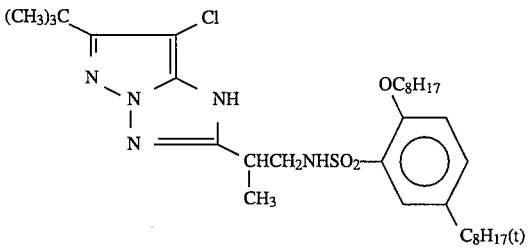

(I-50)

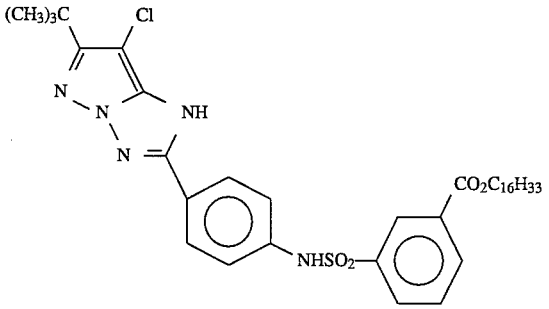

(I-51)

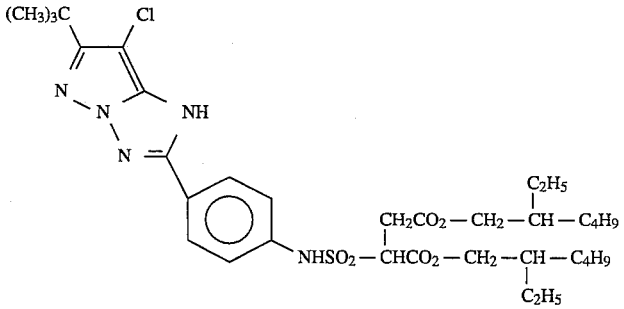

(I-52)

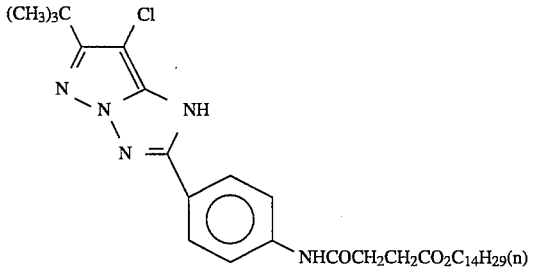

(I-53)

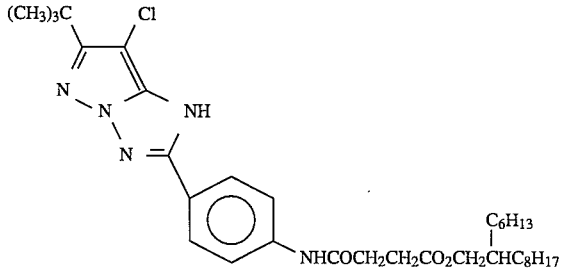

(I-54)

Next, the compounds represented by general formula (III) will be described.

In general formula (III), where $R_{13}$ and $R_{23}$ together form a ring, $R_{43}$ is preferably a hydroxy group or an alkoxy group, and most desirably a hydroxy group, a methoxy group, an ethoxy group or a propoxy group. When $R_{33}$ and $R_{43}$ together form a ring, $R_{13}$ is preferably an alkyl group, an aryl group or a heterocyclic group, and it is more desirably an alkyl group, and most desirably an alkyl group of a carbon number not more than 8.

The compounds represented by general formula (III) preferably form spiro rings.

Actual examples of the compounds which can be represented by general formula (III) are indicated below, but the invention is not limited by these examples.

(III-1)
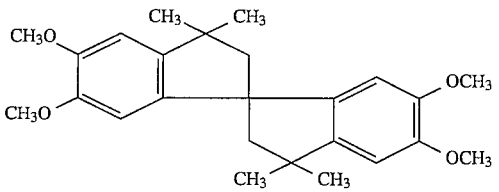
(III-2)
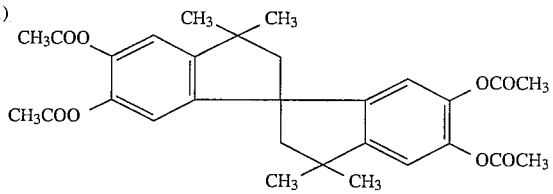
(III-3)
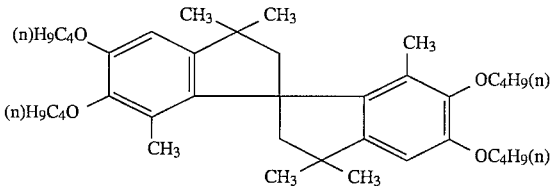
(III-4)
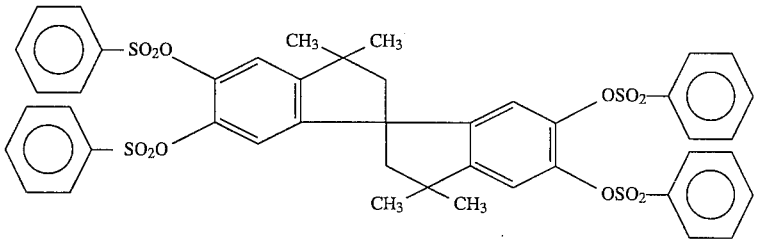
(III-5)
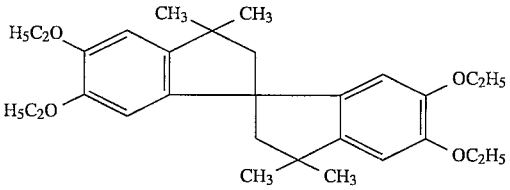
(III-6)
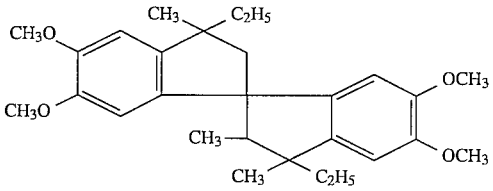
(III-7)
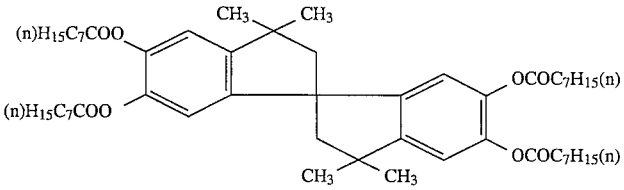
(III-8)
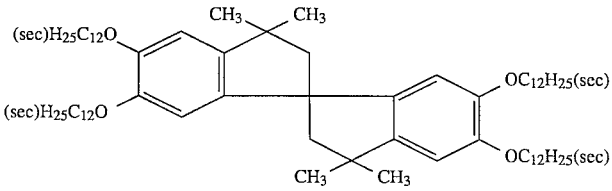
(III-9)
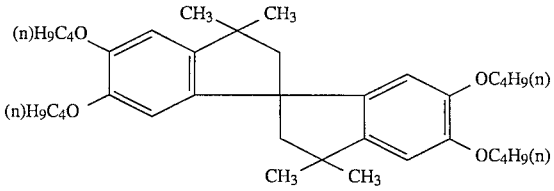
(III-10)
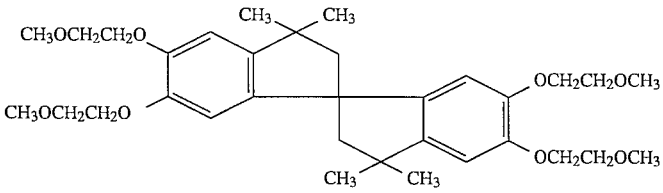

-continued
(III-11)
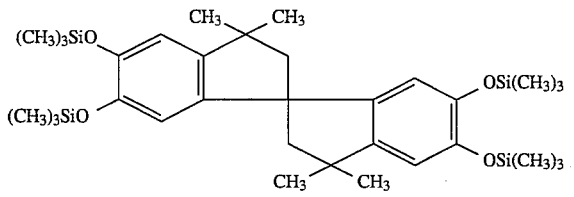
(III-12)
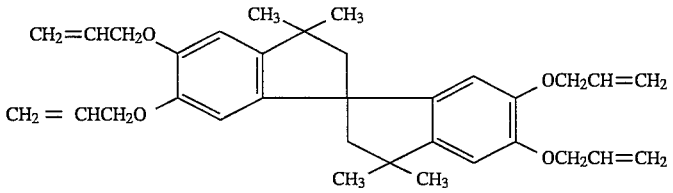
(III-13)
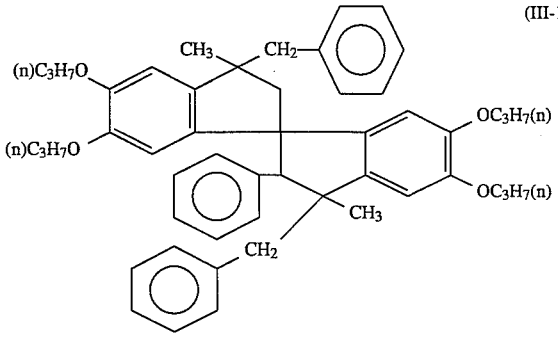
(III-14)
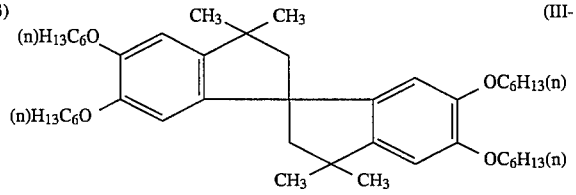
(III-15)
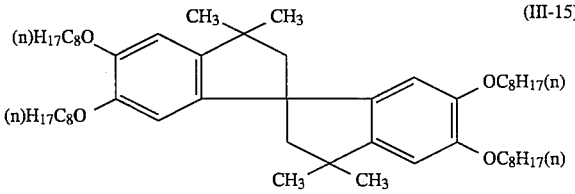
(III-16)
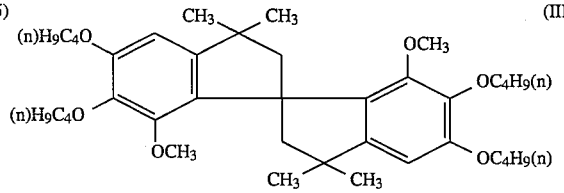
(III-17)
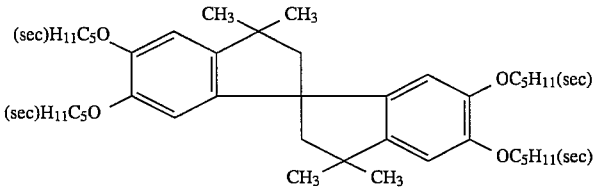
(III-18)
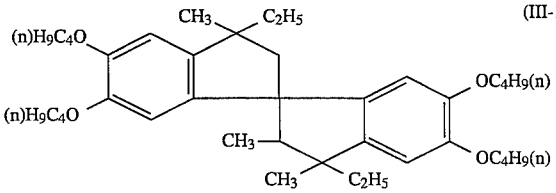
(III-19)
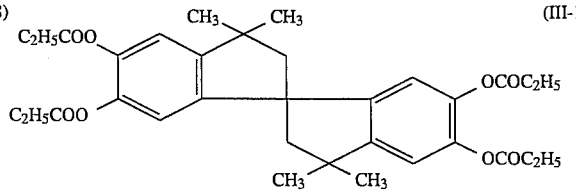
(III-20)
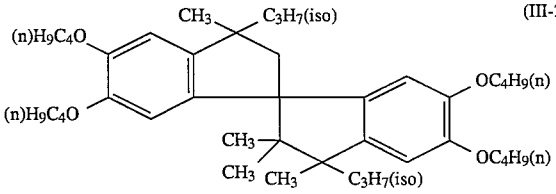
(III-21)
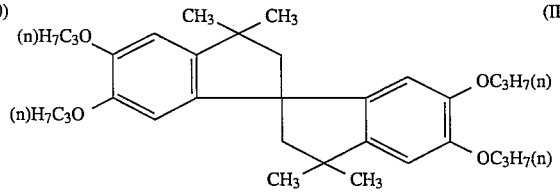

-continued (III-22)

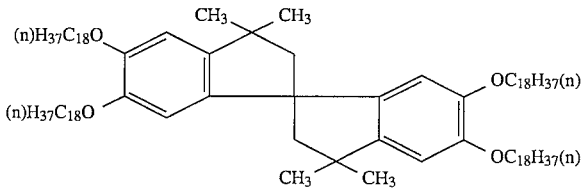

(III-23)

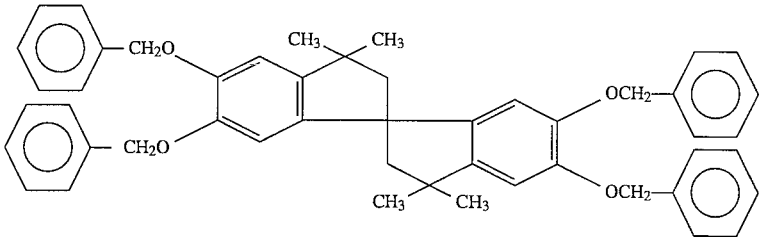

(III-24)

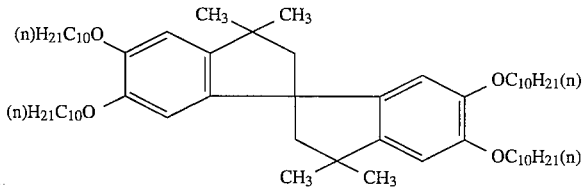

(III-25)

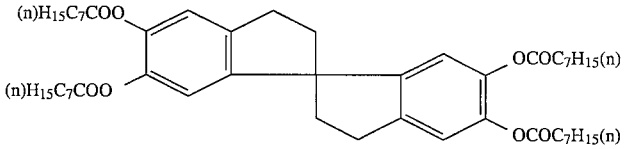

(III-26)

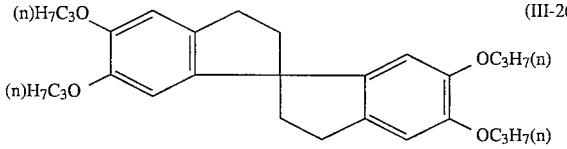

(III-27)

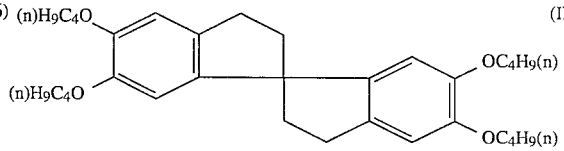

(III-28)

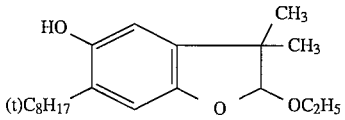

(III-29)

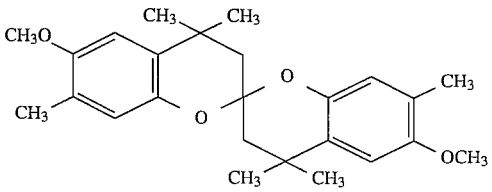

(III-30)

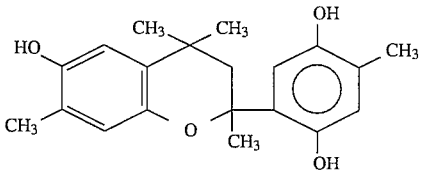

Next, the preferred substituent groups of the compounds represented by general formula (IV) will be described.

The methine group which links the two benzene rings is preferably linked in the ortho position or the para position with respect to the respective oxygen atoms. $R_{34}$ is preferably a hydrogen atom, an alkyl group (for example, methyl, butyl, benzyl) or an acyl group (for example, acetyl, acryloyl).

When $R_{84}$ is not a hydrogen atom, $R_{44}$ and $R_{64}$ are preferably primary or secondary alkyl groups (for example methyl, ethyl, isopropyl, cyclohexyl, benzyl), and $R_{54}$ and $R_{74}$ are preferably primary alkyl groups (for example, methyl, ethyl, decyl). When $R_{84}$ is a hydrogen atom, $R_{44}$ and $R_{64}$ are preferably secondary or tertiary alkyl groups, and $R_{54}$ and $R_{74}$ are preferably tertiary alkyl groups. $R_{84}$ is preferably a branched alkyl group of a carbon number 3–12.

Actual examples of compounds which can be represented by general formula (IV) are indicated below, but of course they are not limited to these compounds.

B-1

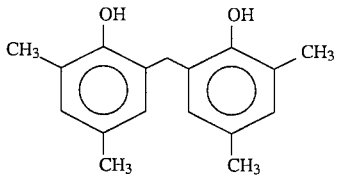

-continued
B-2
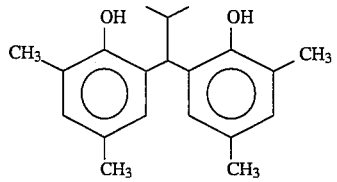
B-3
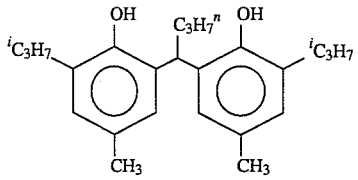
B-4
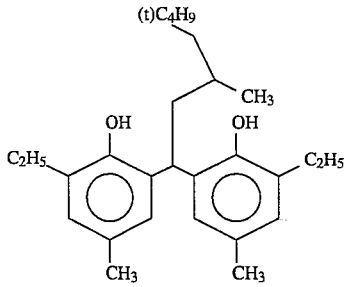
B-5
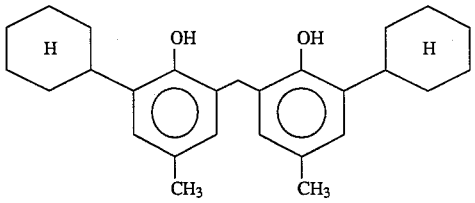
B-6
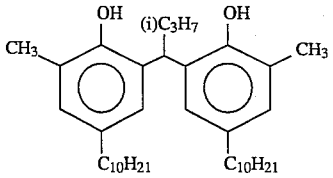
B-7
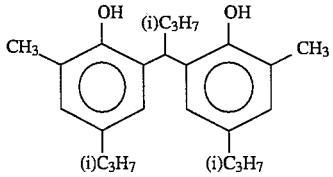
B-8
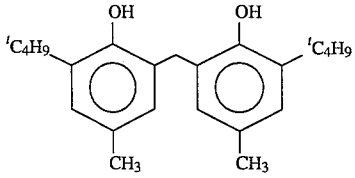
B-9
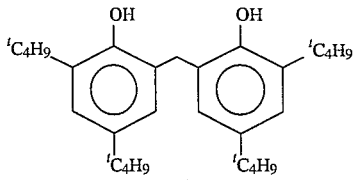
-continued
B-10
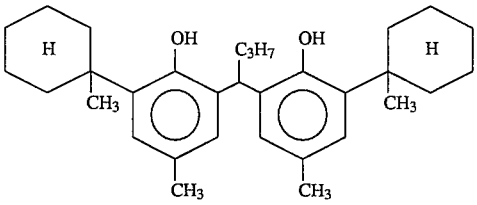
B-11
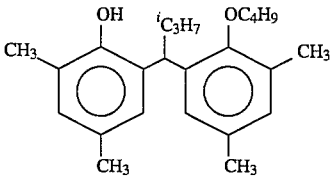
B-12
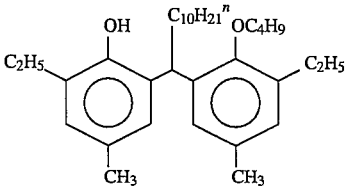
B-13
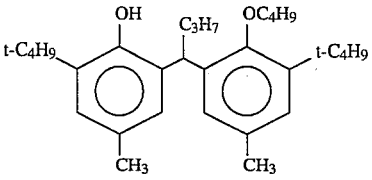
B-14
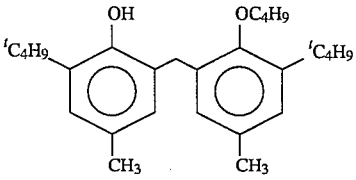
B-15
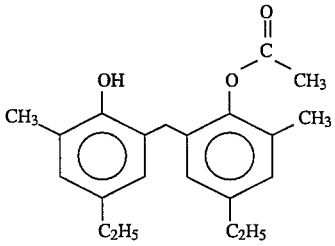
B-16
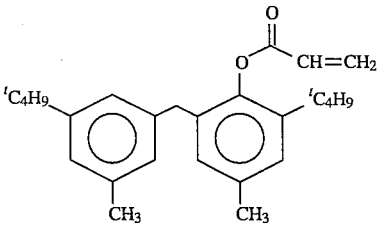
B-17
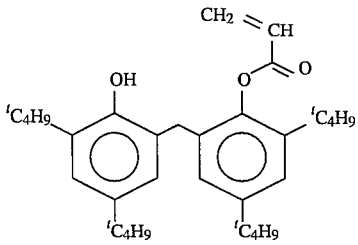

-continued

B-18

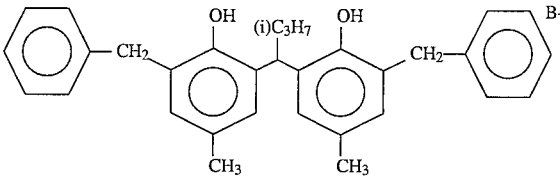

B-19

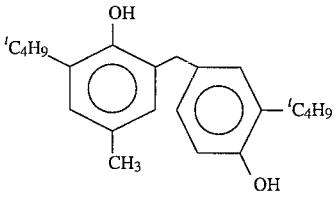

B-20

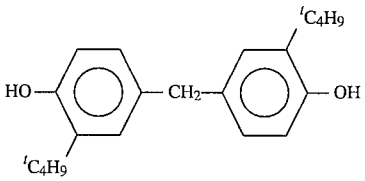

B-21

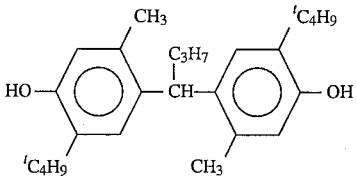

Next, the compounds represented by general formula (V) will be described in detail. In general formula (V), $R_9$ represents a hydrogen atom, an alkyl group, an aryl group or an acyl group. $R_{10}$ and $R_{11}$ represent substituted or unsubstituted alkyl groups or alkoxy groups, and the substituents for the substituted alkyl groups or alkoxy groups may be those permitted for $R_{16}$–$R_{18}$. $W_2$ represents a monovalent group which can be substituted on a benzene ring.

In general formula (V), $R_{10}$ and $R_{11}$ are preferably secondary or tertiary alkyl groups, and tertiary alkyl groups are the more desirable.

A hydrogen atom is more preferred for $R_9$.

A substituted or unsubstituted alkoxycarbonyl group, aryloxycarbonyl group, alkyl group, carbamoyl group or sulfamoyl group is preferred for $W_2$.

Actual examples of compounds which can be represented by general formula (V) are indicated below, but the invention is not limited thereto.

H-1

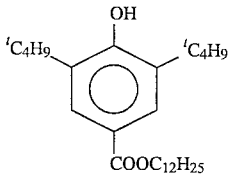

-continued

H-2

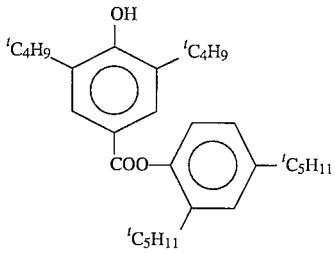

H-3

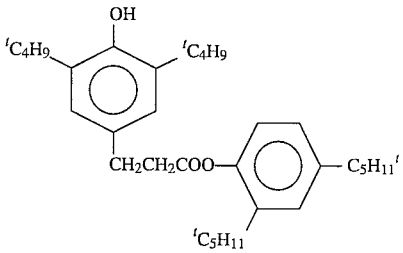

H-4

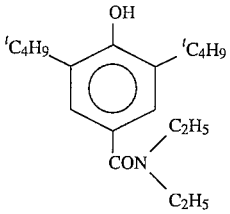

H-5

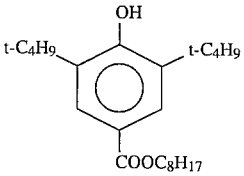

H-6

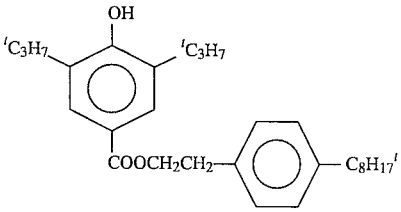

H-7

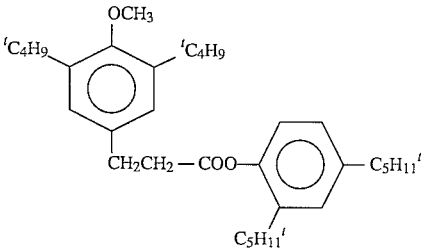

-continued

H-8

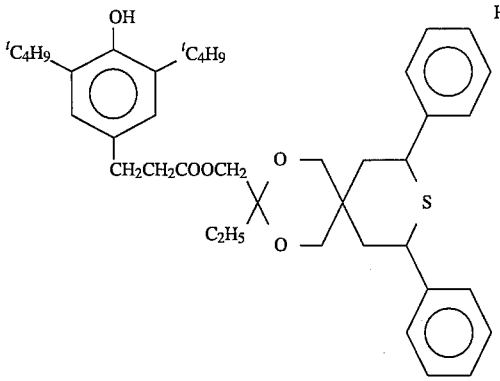

H-9

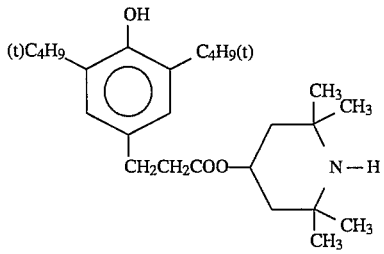

H-10

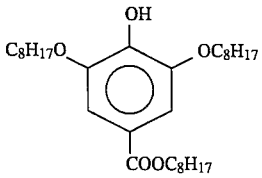

H-11

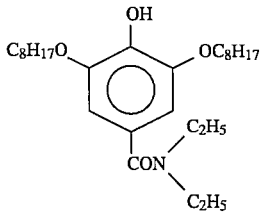

H-12

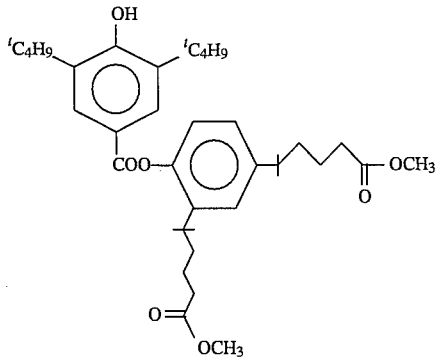

In general formula (VI), an —SO—, —$SO_2$— or —PO(R')— group is preferred for $Q_2$, and the —$SO_2$— group is the most desirable. R' represents an alkyl group.

$R_{12}$ represents an alkyl group (preferably of a carbon number 1–20), an alkoxy group, an aryloxy group or an acyloxy group, and these groups may be substituted with the substituent groups permitted for $R_{16}$–$R_{18}$.

$W_3$ represents a monovalent group which can be substituted on a benzene ring, for example, a group as shown for $W_2$ in general formula (V).

Actual examples of compounds which can be represented by general formula (VI) are indicated below, but the invention is not limited thereto.

A-1

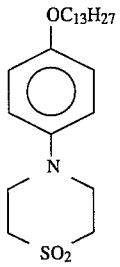

A-2

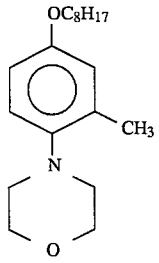

A-3

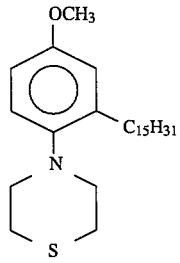

A-4

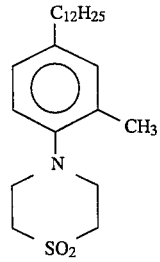

A-5

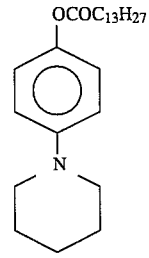

A-6

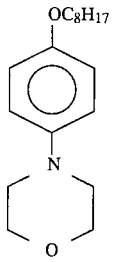

A-7

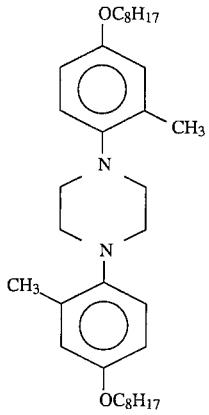

A-8

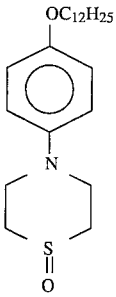

A-9

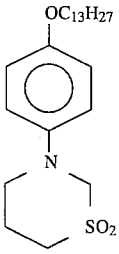

A-10

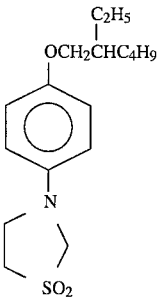

A-11

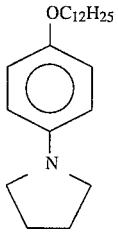

A-12

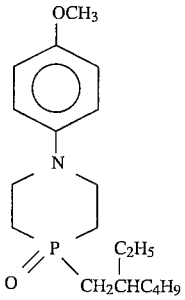

A-13

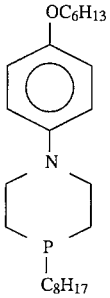

A-14

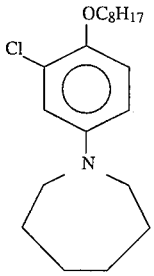

Each of the groups of the compounds represented by general formulae (VII) and (VIII) is described in detail below.

The aliphatic groups represented by $R_{21}$ $R_{30}$ are linear chain, branched chain or cyclic alkyl groups, alkenyl groups or alkynyl groups, and these may be further substituted.

The aromatic groups represented by $R_{21}$ and $R_{30}$ may be carbocyclic aromatic groups (for example, phenyl, naphthyl) or heterocyclic aromatic groups (for example, furyl, thienyl, pyrazolyl, pyridyl, indolyl), and they may be single ring systems or condensed ring systems (for example, benzofuryl, phenanthrizinyl). Moreover, these aromatic groups may be substituted.

The heterocyclic groups represented by $R_{21}$ and $R_{30}$ are preferably groups which have a three- to ten-membered ring structure which is comprised of carbon atoms, oxygen atoms, nitrogen atoms, sulfur atoms and hydrogen atoms, the heterocyclic ring itself may be saturated or unsaturated, and it may be further substituted (for example, chromanyl, pyrrolidyl, pyrrolinyl, morpholinyl).

X in general formula (VII) represents a group which is eliminated on reaction with an aromatic amine-based developing agent, representing an oxygen atom, a sulfur atom or a nitrogen atom, and it is preferably a group which is bonded to A via an oxygen atom, a sulfur atom or a nitrogen atom (for example, 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzthiazolyl, 2-furyloxy, 2-thiophenyloxy, 4-pyridyloxy, 3-isooxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazolin-5-oxy, aryloxy, alkoxy, alkylthio, arylthio, substituted N-oxy), or a halogen atom.

A in general formula (VII) represents a group which reacts with an aromatic amine based developing agent and forms a chemical bond, and it contains a group which includes an atom of low electron density, for example:

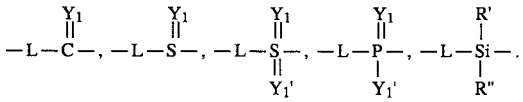

In those cases where X is a halogen atom, n represents 0. Here L represents a single bond, an alkenyl group, —O—, —S—, —N(—R''')—, —L'—C(=$Y_1$)—L''—, —L'—S(=$Y_1$)—L''—, or —L'—S(=$Y_1$)(=$Y_1$')—L''— (for example, a carbonyl group, a sulfonyl group, a sulfinyl group, an oxycarbonyl group, a phosphonyl group, a thiocarbonyl group, an aminocarbonyl group or a silyloxy group).

$Y_1$ and $Y_1$' represent groups which promote addition of the aromatic amine developing agents to the compound of general formula (VII).

R' R'' may be the same or different, each representing —L'''—$R_{21}$. R''' represents a hydrogen atom, an aliphatic group (for example, methyl, isobutyl, tert-butyl, vinyl, benzyl, octadecyl, cyclohexyl), an aromatic group (for example, phenyl, pyridyl, naphthyl), a heterocylic group (for example, piperidinyl, pyranyl, furanyl, chromanyl), an acyl group (for example, acetyl, benzoyl) or a sulfonyl group (for example, methanesulfonyl, benzenesulfonyl).

L', L'' and L''' represent —O—, —S— or —N(—R''')—. L''' also can represent a single bond.

From among these groups, A is preferably a divalent group which can be represented by —O—C(=O)—, —S—C(=O)— or alkylene—C(=O)—.

Those of the compounds represented by general formula (VII) which can be represented by general formulae (VII-a), (VII-b), (VII-c) or (VII-d) are preferred, and they are compounds with react with p-anisidine with a second order reaction rate constant $k_2$ (80° C.) within the range of from $1\times10^{-1}$ liter/mol.sec to $1\times10^{-5}$ liter/mol.sec.

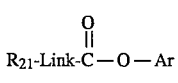

(VII-a)

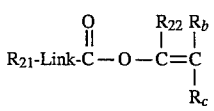

(VII-b)

-continued

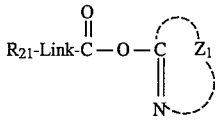

(VII-c)

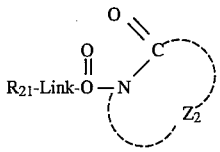

(VII-d)

In these formulae, $R_{21}$ and $R_{22}$ have the same meaning as $R_{21}$ in general formula (VII). Link represents a single bond or —O—. Ar represents an aromatic group which is defined in the same way as $R_{21}$. However, the group which is released as a result of the reaction with an aromatic amine-based developing agent is preferably not a hydroquinone derivative or a catechol derivative, for example, a group which is useful as a photographic reducing agent. Rb and Rc may be the same or different, each representing a hydrogen atom or an aliphatic group, aromatic group or heterocyclic group which is defined in the same way as $R_{21}$ and $R_{22}$. Rb and Rc moreover represent alkoxy groups, aryloxy groups, heterocyclic oxy groups, alkylthio groups, arylthio groups, heterocylic thio groups, amino groups, alkylamino groups, acyl groups, amido groups, sulfonamido groups, sulfonyl groups, alkoxycarbonyl groups, sulfo groups, carboxyl groups, hydroxyl groups, acyloxy groups, ureido groups, urethane groups, carbamoyl groups or sulfamoyl groups. Here, Rb and Rc may be joined together to form a five- to seven-membered heterocyclic ring, and this heterocyclic ring may be further substituted, it may take the form of a spiro ring or a bicyclo ring, or it may be condensed with an aromatic ring.

$Z_1$ and $Z_2$ represent groups of non-metal atoms which are required to form five- to seven-membered heterocyclic rings, and these rings may be further substituted, they may take the form of a spiro or bicyclo ring, or they may be condensed with an aromatic ring.

When, in general formula (VII-a) in particular, Ar is a carbocyclic aromatic group, the substituents thereon can be adjusted to adjust the second order reaction rate constant $k_2$ (80° C.) with p-anisidine to within the range of from $1\times10^{-1}$ liter/mol.sec to $1\times10^{-5}$ liter/mol.sec. At this time, although it depends on the type of group for $R_{21}$, the sum of the Hammett σ-values for each substituent group is preferably at least 0.2, more desirably at least 0.4, and most desirably at least 0.6.

In those cases where a compound represented by general formula (VII-a)–(VII-d) is added during the manufacture of a photographic material, the compound itself preferably has at least 13 carbon atoms in total. For realizing the aims of the present invention, the compound of the present invention is preferably one which is not degraded during development processing.

Among the compounds represented by general formula (VII), the compounds represented by general formula (VII-a) or general formula (VII-c) are preferred, and those represented by general formula (VII-a) are especially desirable.

Z in general formula (VIII) represents a nucleophilic group or a group which dissociates in the photographic material and releases a nucleophilic group. For example, nucleophilic groups in which the atom which bonds chemically directly with the oxidized form of an aromatic amine developing agent is an oxygen atom, a sulfur atom or a nitrogen atom (for example, amine compounds, azide compounds, hydrazine compounds, mercapto compounds, sulfide compounds, sulfinic acid compounds, cyano compounds, thiocyano compounds, thiosulfate compounds, selenium compounds, halide compounds, carboxy compounds, hydroxamic acid compounds, active methylene compounds, phenol compounds, nitrogen heterocyclic compounds) can be used.

The preferred compounds of general formula (VIII) can be represented by the general formula (VIII-a) indicated below.

General Formula (VIII-a)

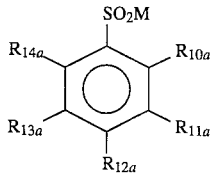

In this formula, M represents an atom or group of atoms which forms an inorganic (for example, Li, Na, K, Ca, Mg, ammonia) or organic (for example, triethylamine, methylamine) salt, —NHN=C(—$R_{15a}$)(—$R_{16a}$), —N(—$R_{17a}$)—N(—$R_{18a}$)— $SO_2R_{19a}$, —N(—$R_{20a}$)—N(—$R_{21a}$)—C(=O)—$R_{22a}$, —C(—$OR_{25a}$)(—$R_{24a}$)—C(=O)—$R_{23a}$ or a hydrogen atom.

Here, $R_{15a}$ and $R_{16a}$ may be the same or different, each representing a hydrogen atom, an aliphatic group, an aromatic group or a heterocyclic group. $R_{15a}$ and $R_{16a}$ may be joined together to form a five- to seven-membered ring. $R_{17a}$, $R_{18a}$, $R_{20a}$ and $R_{21a}$ may be the same or different, each representing a hydrogen atom, an aliphatic group, an aromatic group, a heterocyclic group, an acyl group, an alkoxycarbonyl group, a sulfonyl group, a ureido group or a urethane group.

However, at least one of $R_{17a}$ and $R_{18a}$, and at least one of $R_{20a}$ and $R_{21a}$ is a hydrogen atom. $R_{19a}$ and $R_{22a}$ represent hydrogen atoms, aliphatic groups, aromatic groups or heterocyclic groups. $R_{19a}$ may also represent an alkylamino group, an arylamino group, an alkoxy group, an aryloxy group, an acyl group, an alkoxycarbonyl group or an aryloxycarbonyl group. Here, at least two of the groups represented by $R_{17a}$, $R_{18a}$ and $R_{19a}$ may be joined together to form five-to seven- membered rings, and at least two of the groups represented by $R_{20a}$, $R_{21a}$ and $R_{22a}$ may be joined together to form five- to seven-membered rings. $R_{23a}$ represents a hydrogen atom, an aliphatic group, an aromatic group or a heterocyclic group, and $R_{24a}$ represents a hydrogen atom, an aliphatic group, an aromatic group, a halogen atom, an acyloxy group or a sulfonyl group. $R_{25a}$ represents a hydrogen atom or a hydrolyzable group.

$R_{10a}$, $R_{11a}$, $R_{12a}$, $R_{13a}$ and $R_{14a}$ may be the same or different, each representing a hydrogen atom, an aliphatic group (for example, methyl, isopropyl, tert-butyl, vinyl, benzyl, octadecyl, cyclohexyl), an aromatic group (for example, phenyl, naphthyl), a heterocyclic group (for example, pyridyl, piperidyl, pyranyl, furanyl, chromanyl), a halogen atom (for example, chlorine, bromine), —$SR_{26a}$, —$OR_{26a}$, —N(—$R_{27a}$)—$R_{26a}$, an acyl group (for example, acetyl, benzoyl), an alkoxycarbonyl group (for example, methoxycarbonyl, butoxycarbonyl, cyclohexyloxycarbonyl, octyloxycarbonyl), an aryloxycarbonyl group (for example, phenyloxycarbonyl, naphthyloxycarbonyl), a sulfonyl group (for example, methanesufonyl, benzenesulfonyl), a sulfonamido group (for example, methanesulfonamido, benzenesulfonamido), a sulfamoyl group, a ureido group, a urethane group, a carbamoyl group, a sulfo group, a carboxyl group, a nitro group, a cyano group, an alkoxalyl group (for example, methoxalyl, isobutoxalyl, octyloxalyl, benzoyloxalyl), an aryloxalyl group (for example, phenoxalyl, naphthoxalyl), a sulfonyloxy group (for example, methanesulfonyloxy, benzenesulfonyloxy), —P(—$R_{29a}$)—$R_{28a}$, —P(=O)(—$R_{29a}$)—$R_{28a}$, —P(=S)(—$R_{28a}$)—$R_{29a}$ or a formyl group. Here, $R_{26a}$ and $R_{27a}$ may be the same or different, each representing a hydrogen atom, an aliphatic group, an aromatic group, an acyl group or a sulfonyl group. $R_{28a}$ and $R_{29a}$ may be the same or different, each representing a hydrogen atom, an aliphatic group, an aromatic group, an alkoxy group or an aryloxy group.

Among these, the groups where the total sum of the Hammett σ-values of the benzene substituent groups with respect to the —$SO_2M$ group is at least 0.5 are preferred from the viewpoint of the effect of the present invention.

Actual examples of these compounds are indicted below, but the compounds which can be used in the present invention are not limited by these examples.

(VII-1)

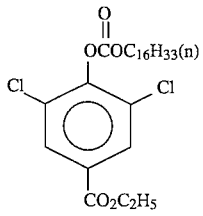

(VII-2)

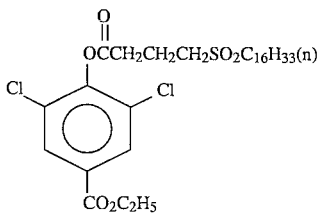

(VII-3)

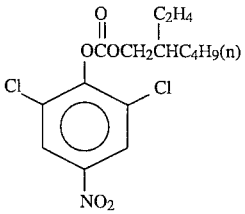

(VII-4)

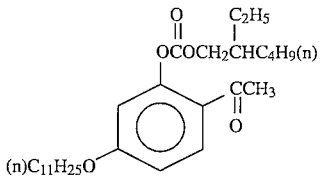

-continued
(VII-5)
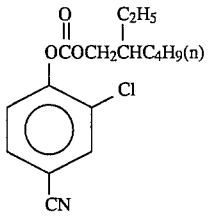
(VII-6)
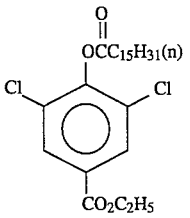
(VII-7)
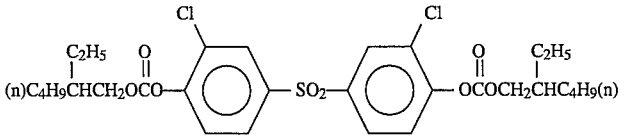
(VII-8)
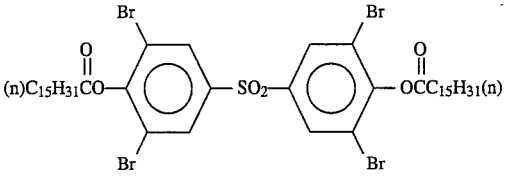
(VII-9)
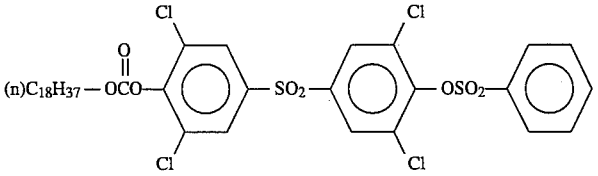
(VII-10)
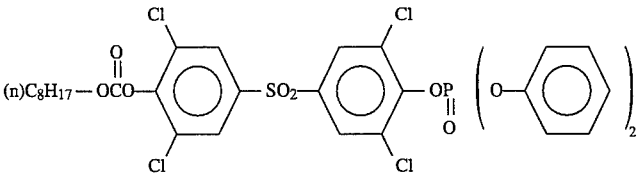
(VII-11)
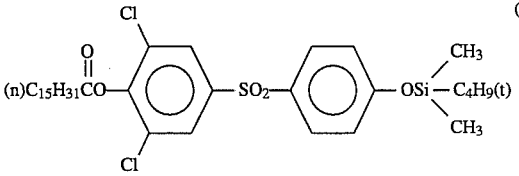
(VII-12)
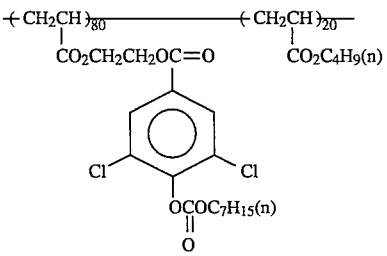
(VII-13)
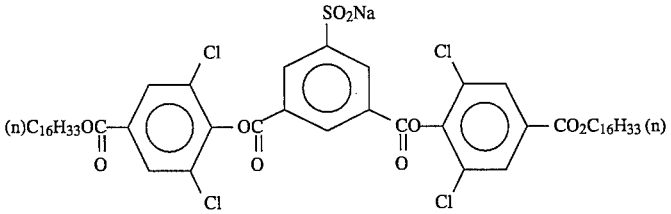
(VIII-1)
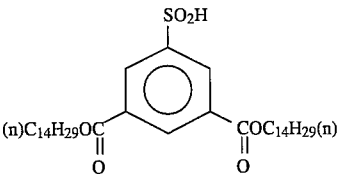
(VIII-2)
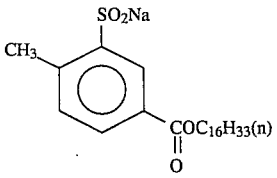

-continued (VIII-3)

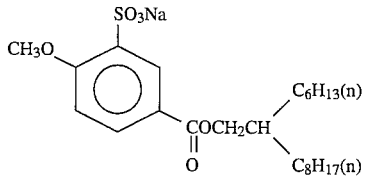

(VIII-4)

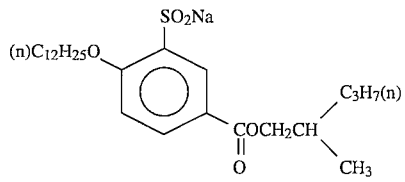

(VIII-5)

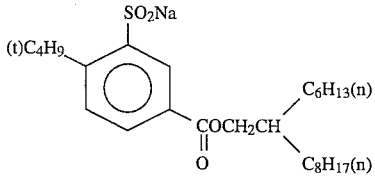

(VIII-6)

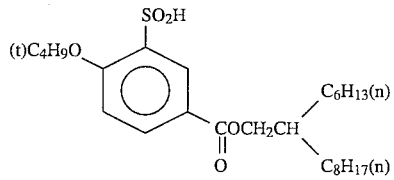

(VIII-7)

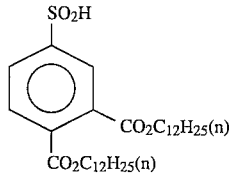

(VIII-8)

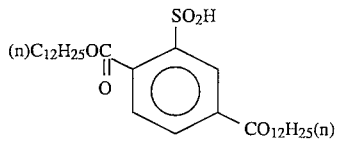

(VIII-9)

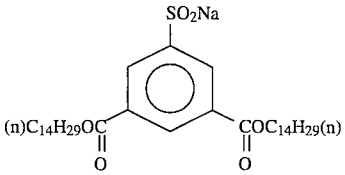

(VIII-10)

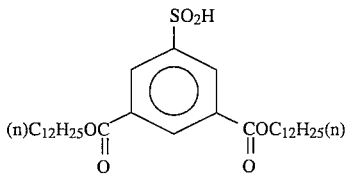

(VIII-11)

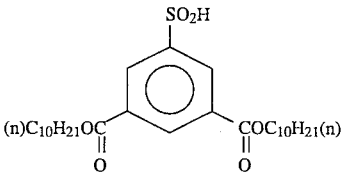

(VIII-12)

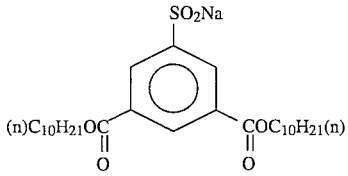

These compounds represented by general formulae (VII) and (VIII) can be prepared using the methods disclosed in JP-A-62-143048, JP-A-63-115855, JP-A-63-115866, JP-A-63-158545 and European Patent Laid Open 255,722, and methods based upon these methods.

The preferred compounds of the present invention also include the compounds cited as actual examples in the specifications of the above mentioned patents and JP-A-62-283338 and JP-A-62-229145.

Of the compounds represented by general formulae (VII) and ( VIII), those of low molecular weight or which dissolve readily in water may be added to a processing bath for incorporation into the photographic material at the development processing stage. Methods in which they are added to the hydrophilic colloid layers of the photographic materials while the photographic material is being manufactured are preferred.

The coupler represented by general formula (I) of the present invention can generally be used in an amount of from $1\times10^{31\ 2}$ to 1 mol, and preferably in an amount of from $1\times10^{-1}$ to $5\times10^{-1}$ mol, per mol of silver halide. Furthermore, other types of magenta couplers can be used conjointly with the couplers of the present invention.

The compounds represented by general formulae (II), (IV), (V) and (VI) of the present invention are preferably added in amounts of from 0.5 to 150 mol %, and most desirably in amounts of from 1 to 100 mol %, with respect to the coupler of general formula (I) of the present invention.

The compounds represented by the general formulae (VII) and (VIII) of the present invention are preferably dissolved in a high boiling point organic solvent, and they are preferably added in an amount of from $1\times10^{-2}$ to 10 mol, and most desirably in an amount of from $3\times10^{-2}$ to 5 mol, per mol of the coupler of general formula (I) of the present invention.

A color photographic material of the present invention can be constructed by coating one by one at least a yellow color forming silver halide emulsion layer, a magenta color forming silver halide emulsion layer and a cyan color forming silver halide emulsion layer on a support which has a reflecting layer. In a general color printing paper, color reproduction with the subtractive method can be achieved by including color couplers which form dyes which have a complementary relationship with the light to which the silver halide emulsion is sensitive. A general color printing paper can be constructed by spectrally sensitizing the silver halide emulsion grains with blue sensitive, green sensitive and red sensitive spectral sensitizing dyes in the order of the aforementioned color forming layers and coating the layers containing these dyes in the aforementioned order on the support. However, the order may be different from that aforementioned. Thus, there are cases where it is desirable from the viewpoint of rapid processing to locate the light-sensitive layer which contains the silver halide grains which have of the largest average grain size as the uppermost layer, and cases in which it is desirable from the viewpoint of the storage properties under illumination to locate the magenta color forming light-sensitive layer as the lowermost layer.

Furthermore, the light-sensitive layers and the color forming hues may not have the correspondence described above, and it is possible to make use of at least one layer which is an infrared sensitive silver halide emulsion layer.

The use of silver chloride, silver chlorobromide or silver chloroiodobromide grains of which the silver chloride content is at least 95 mol % for the silver halide grains is desirable in the present invention. In the present invention, the use of a silver halide comprised of silver chlorobromide or silver chloride which is essentially silver iodide free is especially desirable for speeding up development processing. Here, the term "essentially silver iodide free" signifies that the silver iodide content is not more than 1 mol %, and preferably not more than 0.2 mol %. On the other hand, there are also cases in which the use of high silver chloride grains which contain 0.01–3 mol % of silver iodide at the emulsion surface as disclosed in JP-A-3-84545 is desirable with a view to increasing the photographic speed under high levels of illumination, increasing the spectrally sensitized photographic speed or for raising the ageing stability of the photographic material.

The halogen composition in an emulsion may differ from grain to grain or it may be the same from grain to grain, but it is easy to achieve a uniform nature from grain to grain if an emulsion in which the halogen composition is the same from grain to grain is used. Furthermore, the halogen composition within the silver halide emulsion grains may be selected appropriately, and grains which have a so-called uniform structure in which the composition is the same in all parts of the silver halide grains, grains which have a so-called layer type structure in which the halogen compositions in the core which forms the interior of the silver halide grains and in the surrounding shell (which may be a single layer or a plurality of layers) are different, or grains which have a structure in which there are parts which have a different halogen composition in a non-layerlike form within the grains or on the surfaces of the grains (structures in which parts which have a different halogen composition are joined onto the edges, corners or surfaces of the grains where the parts which have a different composition are at the surface of the grains), can be used. The use of grains of either of the latter two types is preferable to the use of grains which have a uniform structure for obtaining a high photographic speed, and it is also preferred from the point of view of the pressure resisting properties. In those cases where the silver halide grains have a structure such as one of those indicated above, the boundary region between the parts which have different halogen compositions may be a distinct boundary, or it may be an indistinct boundary where a mixed crystal is formed according to the difference in composition, or it may be such that there is a positive and continuous change in the structure.

A structure which has a local silver bromide phase in a layerlike form or non-layerlike form within the silver halide grain and/or at the grain surface of the type described earlier is preferred in a high silver chloride emulsion which can be used in the present invention. The halogen composition of the above-mentioned local phase preferably has at least 10 mol % as a silver bromide content, and most desirably it has more than 20 mol % as a silver bromide content. The silver bromide content of the silver bromide local layer can be analyzed using the X-ray diffraction method (for example, that described in the Japanese Chemical Society publication *New Experimental Chemistry Course* 6, *Structure Analysis*, published by Maruzen) or like methods. Thus, these local phases can be within the grain, or at the edges or corners of the grain surfaces, or on the grain surface, but those cases where it is grown epitaxially on the corners of the grains can be cited as a preferred examples.

Furthermore, a higher silver chloride content in the silver halide emulsion is also effective for reducing the replenishment rate of the development processing baths. In such a case, the use of a virtually pure silver chloride which has a silver chloride content of 98–100 mol % is also desirable.

The average grain size of the silver halide grains included in the silver halide emulsions which are used in the present invention is preferably 0.1 μm–2 μm. (The average grain size is the numerical average of the grain size which is taken to be the diameter of the circular area equal to the projected area of the grain.)

Furthermore, the grain size distribution of these grains is preferably that of a so-called mono-dispersion of which the variation coefficient (the value obtained by dividing the standard deviation of the grain size distribution by the average grain size) is desirably not more than 20%, more desirably not more than 15%, and most desirably not more than 10%. At this time, the use of blends of the above-mentioned mono-dispersions in the same layer, or the lamination coating of the above-mentioned mono-dispersions, is desirable for obtaining a wide latitude.

The silver halide grains which are included in the photographic emulsion may have a regular crystalline form such as a cubic, tetradecahedral or octahedral form, an irregular crystalline form such as a spherical or plate-like form, or a form which is a composite of such crystalline forms. Furthermore, mixtures of grains which have various crystalline forms may be used. At least 50%, preferably at least 70%, and most desirably at least 90%, of grains which have the above-mentioned regular crystalline form should be included in the mixtures of grain used in the present invention.

Furthermore, the use of emulsions in which tabular grains which have an average aspect ratio (diameter of the calculated circle/thickness) of at least 5, and preferably of at least 8, account for more than 50% of all the grains in terms of projected area is also desirable.

The silver chloride(bromide) emulsions used in the present invention can be prepared using the methods disclosed, for example, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsion*, published by Focal Press, 1964. That is to say, they can be prepared using, for example, acidic methods, neutral methods and ammonia methods, and a single-sided mixing procedure, a simultaneous mixing procedure, or a combination of such procedures can be used for reacting the soluble silver salt with the soluble halogen salt. Methods in which the grains are formed in the presence of an excess of silver ions (so-called reverse mixing methods) can also be used. The method in which the pAg value in the liquid phase in which the silver halide is being formed is held constant, which is to say the so-called controlled double jet method, can also be used as one type of simultaneous mixing procedure. It is possible to obtain silver halide emulsions with an almost uniform grain size with a regular crystalline form if this method is used.

The inclusion of different types of metal ions other than silver ion or complex ions in the local phase or in the substrate (the portion other than the local phase) of the silver halide grains of the present invention is desirable. The preferred metal ions are selected from among the metal ions or metal complexes belonging to group VIII or IIb of the periodic table, and lead ions and thallium ions. Combinations of ions or complex ions selected from among iridium, rhodium, iron and the like can be used in the main in the local phase, and combinations of metal ions or complex ions selected from among osmium, iridium, rhodium, platinum, ruthenium, palladium, cobalt, nickel, iron and the like can be used in the main in the substrate. Furthermore, different types and concentrations of metal ions can be used in the local phase and in the substrate. A plurality of these metals may be used. The presence of iron and iridium compounds in the silver bromide local phase is especially desirable.

Compounds which supply these metal ions are included in the local phase and/or the substrate of the grain in a silver halide grain of the present invention, for example, by addition to the aqueous gelatin solution which forms the dispersion medium, to the aqueous halide solution, the aqueous silver salt solution or some other aqueous solution during the formation of the silver halide grains, or by addition with the dissolution of fine silver halide grains in which the metal ions have been included beforehand.

The inclusion of the metal ions which are used in the present invention in the emulsion grains can be achieved either before grain formation, during grain formation or immediately after grain formation. They can be varied according to where in the grains the metal ions are to be included.

The silver halide emulsions used in the present invention are generally subjected to chemical sensitization and spectral sensitization.

Chemical sensitization with chalcogen sensitizers (in practical terms, sulfur sensitization as typified by the addition of unstable sulfur compounds or selenium sensitization with selenium compounds or tellurium sensitization with tellurium compounds), precious metal sensitization as typified by gold sensitization, or reduction sensitization, for example, can be used individually or conjointly for chemical sensitization. The use of the compounds disclosed from the lower right hand column on page 18 to the upper right hand column of page 22 of JP-A-62-215272 as the compounds which are used for chemical sensitization is desirable.

The effect of the structure of the photographic materials of the present invention is pronounced when a high silver chloride emulsion which has been gold sensitized is used.

The emulsions used in the present invention are so-called surface latent image-type emulsions, in which the latent image is formed predominantly on the surfaces of the grains.

Various compounds or precursors thereof can be added to the silver halide emulsions which are used in the present invention with a view to preventing the occurrence of fogging during the manufacture, storage or photographic processing of the photographic material or with a view to stabilizing photographic performance. The compounds disclosed on pages 39–72 of the previously mentioned JP-A-62-215272 can be used desirably as actual examples of such compounds. Moreover, use of the 5-arylamino-1,2,3,4-thiatriazole compounds (which have at least one electron withdrawing group on the aryl residual group) disclosed in European Patent EP 0447647 is also desirable.

Spectral sensitization is carried out with a view to rendering the emulsion of each layer in a photographic material of the present invention spectrally sensitive to light of a prescribed wavelength region.

The spectral sensitizing dyes described, for example, by F. M. Harmer in *Heterocyclic Compounds-Cyanine Dyes and Related Compounds,* (John Wiley & Sons [New York, London], 1964) can be cited as spectral sensitizing dyes which can be used for spectral sensitization in the blue, green and red regions in a photographic material of the present invention. Use of the examples of actual compounds and spectral sensitization methods disclosed from the upper right hand column on page 22 to page 38 of the aforementioned JP-A-62-215272 is desirable. Furthermore, the spectral sensitizing dyes disclosed in JP-A-3-123340 are especially desirable from the viewpoints of stability, the strength of adsorption and the temperature dependence of the exposure, for example, as red sensitive spectral sensitizing dyes for silver halide emulsion grains which have a high silver chloride content in particular.

In cases where effective spectral sensitization is carried out in the infrared region in the present invention, use of the sensitizing dyes disclosed from the upper left hand column on page 12 to the lower left hand column of page 21 of JP-A-3-15049, from the lower left hand column of page 4 to the lower left hand column on page 15 of JP-A-3-20730, from line 21 on page 4 to line 54 on page 6 of European Patent EP 0,420,011, from line 12 on page 4 to line 33 on page 10 of European Patent EP 0,420,012, in European Patent EP 0,443,466 and in U.S. Pat. No. 4,975,362 is desirable.

For inclusion in a silver halide emulsion, these spectral sensitizing dyes may be dispersed in the emulsion directly, or they may be dissolved in an individual solvent such as water, methanol, ethanol, propanol, methylcellosolve or 2,2,3,3-tetrafluoropropanol, for example, or in a mixture of these solvents, for addition to the emulsion. Furthermore, they may be formed into aqueous solutions which contain acids or bases as disclosed, for example, in JP-B-44-23389, JP-B-44-27555 or JP-B-57-22089, or they can be formed into an aqueous solution or colloidal dispersion in the co-presence of a surfactant, as disclosed for example in U.S. Pat. Nos. 3,822,135 and 4,006,025 for addition to the emulsion. (The term "JP-B" as used herein signifies an "examined Japanese patent publication".) Furthermore, they may be dissolved in a solvent which is essentially immiscible with water, such as phenoxyethanol for example, and then dispersed in water or in a hydrophilic colloid for addition to the emulsion. Direct dispersion in a hydrophilic colloid as disclosed in JP-A-53-102733 and JP-A-58-105141 with addition of the dispersion to the emulsion can also be employed.

The time at which the addition to the emulsion is made may be at any stage during the manufacture of the emulsion which has been useful previously. Thus, the time can be selected from among before the formation of the grains of the silver halide emulsion, during grain formation, before the washing process immediately after grain formation, before chemical sensitization, during chemical sensitization, before cooling and solidifying the emulsion immediately after chemical sensitization, or during the preparation of a coating liquid. The addition is usually made at a time after the completion of chemical sensitization and before coating, but the addition can be made at the same time as the chemical sensitization as disclosed in U.S. Pat. Nos. 3,628,969 and 4,225,666, and spectral sensitization can be carried out at the same time as chemical sensitization, the addition can be made before chemical sensitization as disclosed in JP-A-58-113928, and the addition can also be made and chemical sensitization can be started before the precipitation and formation of the silver halide grains has been completed. Moreover, the addition can be made by dividing the spectral sensitizing dye, which is to say with the addition of some of the dye before chemical sensitization with the remainder being added after chemical sensitization, as disclosed in U.S. Pat. No. 4,225,666, and the addition can be made at any time during the formation of the silver halide grains based on the method described in U.S. Pat. No. 4,183,756. From among these methods, the addition of the sensitizing dye before washing the emulsion or before chemical sensitization is especially desirable.

The amounts in which these spectrally sensitizing dyes are added vary over a wide range depending on the particular case, but the amount is preferably in the range of from $0.5\times10^{-6}$ mol to $1.0\times10^{-2}$ mol per mol of silver halide. The amount is most desirably in the range of from $1.0\times10^{-6}$ mol to $5.0\times10^{-3}$ mol per mol of silver halide.

In those cases where a sensitizing dye which has a spectral sensitizing sensitivity in the range from red to infrared in particular is used in the present invention, the conjoint use of the compounds disclosed from the lower right hand column on page 13 to the lower right hand column on page 22 of JP-A-2-157749 is preferred. By using these compounds, it is possible to increase the stability of the storage properties and processing of the light-sensitive material and to increase the super-sensitizing effect uniquely. The use of compounds of general formulae (IV), (V) and (VI) disclosed in JP-A-2-157749 conjointly is especially desirable. These compounds are generally used in amounts of from $0.5\times10^{-5}$ mol to $5.0\times10^{-2}$ mol, preferably from $5.0\times10^{-5}$ mol to $5.0\times10^{-3}$ mol, per mol of silver halide, and a useful amount in practice is in the range of from 0.1 to 10000 times, preferably from 0.5 to 5000 times, the molar amount of sensitizing dye.

In addition to the use of an ordinary printing system in which a negative printer is employed with the photographic materials of the present invention, it is also possible to use a digital scanning exposure in which monochromatic high density light, such as that from a gas laser, a light emitting diode, a semiconductor laser, or a second harmonic generating light source (SHG) in which a semiconductor laser or a solid laser in which a semiconductor laser is used as an exciting light source and a non-linear optical crystal are combined, is used, and such is preferred. The use of a semiconductor laser or a second harmonic generating light source (SHG) in which a semiconductor laser or a solid laser is combined with a non-linear optical crystal is preferred for providing a compact and inexpensive system. The use of a semiconductor laser is especially desirable for designing an apparatus which is compact, inexpensive, has a long life and is very stable, and the use of at least one semiconductor laser as a light source is desirable.

The spectral sensitization peaks of a photographic material of the present invention can be established according to the wavelengths of the scanning exposure light sources in those cases where such light sources are to be used. It is possible to halve the oscillating wavelength of a laser with an SHG light source which is obtained by combining a non-linear optical crystal with a solid laser in which a semiconductor laser is used as the exciting light source or a semiconductor laser, and thus it is possible to obtain blue light and green light. Hence, the spectral sensitization peaks of the photographic material can be the three usual regions of blue, green and red.

The provision of at least two layers which have spectral sensitization peaks above 670 nm is desirable for using semiconductor lasers as light sources for providing an apparatus which is inexpensive, compact and highly stable. This is because the oscillating wavelengths of stable group III–V-based semiconductor lasers which are inexpensive and easily obtained are, at the present time, only to be found in the region from red to infrared. However, the oscillation of group II–VI-based semiconductor lasers in the green or blue region has been confirmed in the laboratory, and if manufacturing techniques are developed for these semiconductor lasers, it is anticipated that it will be possible to use these semiconductor lasers both in an inexpensive and a stable manner. In such a case the necessity for having at least two layers with a spectral sensitivity peak of at least 670 nm is reduced.

In such a scanning exposure system, the time for which the silver halide in the photographic material is exposed is the time which is required to expose a certain very small area. The smallest unit in which the quantity of light can be controlled for the respective digital data is generally used for this very small area, and such is called a picture element (pixel). Hence, the exposure time per picture element varies with the size of the picture elements. The size of the picture elements depends on the picture element density, and the actual range is from 50 to 2000 dots per inch (dpi). If the exposure time is defined as the time for the exposure of the picture element size when the picture element density is 400 dpi, then the preferred exposure time is not more than $10^{-4}$ seconds, and most desirably not more than $10^{-6}$ seconds.

The dyes (oxonol dyes and cyanine dyes) which can be decolorized by processing as disclosed on pages 27 to 76 of European Patent 0,337,490A2 are preferably added to the hydrophilic colloid layers in a photographic material of the present invention with a view to preventing the occurrence of irradiation and halation and with a view to improving safelight safety, for example.

Among these water soluble dyes, there are some which have an adverse effect on color separation and on safelight safety when the amount used is increased. The water soluble dyes disclosed in EP 0,539,978A1, JP-A-5-127325 and JP-A-5-127324 are preferred as dyes which can be used without adversely affecting color separation.

In the present invention, a colored layer which can be decolorized by processing can be used instead of the water soluble dyes or along with the water soluble dyes. The colored layer which can be decolorized by processing which is used may be in direct contact with an emulsion layer, or it may be arranged in such a way that it is in contact with an emulsion layer via an intermediate layer which contains a processing anti-color mixing agent such as hydroquinone and gelatin. This colored layer is preferably located below (on the support side of) the emulsion layer which forms the same primary color as the color which is dyed. Colored layers can be established corresponding to each of the primary colors, or layers of just some of these colors may be selected and established optionally. Furthermore, a colored layer which has been colored to correspond with a plurality of primary colors can also be established.

The optical reflection density of the colored layers as an optical density at the wavelength of highest optical density in the wavelength region which is used for exposure (with the usual printer exposure, the visible region from 400 nm to 700 nm and the wavelength of the scanning exposure light sources when scanning exposures are used) is preferably at least 0.2 and not more than 3.0. More desirably, it is at least 0.5 and not more than 2.5, and most desirably it is at least 0.8 and not more than 2.0.

Methods used previously can be used to form a colored layer. For example, there is the method in which the dyes disclosed from the lower right column on page 3 to page 8 of JP-A-2-282244 or the dyes disclosed from the upper right column on page 3 to the lower left column on page 11 of JP-A-3-7931 are included in a hydrophilic colloid layer in the form of a dispersion of fine solid particles, the method in which anionic dyes are mordanted in a cationic polymer, the method in which dyes are fixed in a layer by being adsorbed on fine grains of silver halide, for example, and the method in which colloidal silver is used, as disclosed in JP-A-1-239544. As an example of a method in which a finely powdered colorant is dispersed in a solid form, there is the method in which a finely powdered dye which is at least essentially insoluble in water at pH 6 or below and at least essentially soluble in water at pH 8 or above is included, which has been disclosed on pages 4–13 of JP-A-2-308244. Furthermore, a method in which an anionic dye is mordanted with a cationic polymer is disclosed on pages 18–26 of JP-A-2-84637. Methods of preparing colloidal silver as a light absorber have been disclosed in U.S. Pat. Nos. 2,688,601 and 3,459,563. From among these methods, those in which a finely powdered dye is included and those in which colloidal silver is used, for example, are preferred.

The use of gelatin for the binding agent or protective colloid which can be used in a photographic material of the present invention is convenient, but other hydrophilic colloids can be used either independently or together with gelatin. The use of low calcium gelatin which has a calcium content of not more than 800 ppm, and preferably not more than 200 ppm, is desirable as the preferred gelatin. Furthermore, the addition of fungicides as disclosed in JP-A-63-271247 is desirable for preventing the propagation of the fungi and bacteria which occur in hydrophilic colloid layers and which cause the image quality to deteriorate.

Use of the band-pass filters disclosed in U.S. Pat. No. 4,880,726 is desirable when a photographic material of the present invention is exposed with a printer. The light color mixture is removed by such filters, and there is a marked improvement in color reproduction.

The exposed photographic materials can be subjected to the usual color development processing, but in the case of a color photographic material of the present invention, a bleach-fixing process following color development is desirable with a view to rapid processing. Furthermore, in those cases where the aforementioned high silver chloride emulsions are used, the pH of the bleach-fix bath is preferably not more than about 6.5, and most desirably not more than about 6, with a view to the promotion of de-silvering, etc.

The use of the silver halide emulsions and other materials (additives, etc.) which are suitable for use in a photographic material of the present invention, the photographic layer structures (layer arrangements, etc.) and the methods of processing which are suitable for processing these light-sensitive materials and the additives for processing purposes which have been disclosed in the patents indicated below, and especially in European Patent EP 0,355,660A2 (JP-A-2-139544), indicated below is desirable.

TABLE 1

| Photographic Structural Element | JP-A-62-215272 | JP-A-2-33144 | EP 0,355,660A2 |
|---|---|---|---|
| Silver Halide Emulsions | Upper right column on page 10, line 6, to lower left column on page 12, line 5, and lower right column on page 12, fourth line from the bottom, to upper left column on page 13, line 17. | Upper right column on page 28, line 16, to lower right column on page 29, line 11, and page 30. lines 2 to 5. | Page 45 line 53 to page 47 line 3, and page 47 lines 20 to 22 |
| Silver Halide Solvents | Lower left column on page 12, lines 6 to 14, and upper left column on page 13, third line from the bottom to lower left column on page 18, last line | — | — |
| Chemical Sensitizers | Page 12, lower left column, third line fromthe bottom to lower right column, fifth line from the bottom, and lower right column on page 18, line 1, to upper right column on page 22, ninth line from the bottom | Lower right column on page 29 line 12 to the last line. | Page 47, lines 4 to 9 |
| Spectral Sensitizers (Methods of Spectral Sensitization) | Upper right column on page 22, eighth line from the bottom, to last line on page 38 | Upper left column on page 30, lines 1 to 13. | Page 47, lines 10 to 15 |
| Emulsion Stabilizers | Upper left column on page 39, line 1, to upper right column on page 72, last line | Upper left column on page 30, line 14, to upper right column line 1 | Page 47 lines 16 to 19 |
| Development Accelerators | Lower left column on page 72, line 1, to upper right column on page 91, line 3 | | |

TABLE 2

| Photographic Structural Element | JP-A-62-215272 | JP-A-2-33144 | EP 0,355,660A2 |
|---|---|---|---|
| Color Couplers (Cyan, Magenta and Yellow Couplers) | Upper right column on page 91, line 4, to upper left column on page 121, line 6 | Upper right colum on page 3, line 14, to upper left column on page 18, last line, and upper right column on page 30, line 6, to lower right column on page 35, line 11 | Page 4, lines 15 to 27, page 5 line 30 to the last line on page 28, page 45 lines 29 to 31 and page 47, line 23, to page 63, line 50 |
| Super-Sensitizers | Upper left column on page 121, line 7, to upper right column on page 125, line 1 | — | — |
| Ultraviolet Absorbers | Upper right column on page 125, line 2, to lower left column on | Lower right column on page 37, line 14, to upper left | Page 65, lines 22 to 31 |

TABLE 2-continued

| Photographic Structural Element | JP-A-62-215272 | JP-A-2-33144 | EP 0,355,660A2 |
|---|---|---|---|
| | page 127, last line | column on page 38, line 11 | |
| High Boiling Point and/or Low Boiling Point Organic Solvents | Lower left column on page 137, line 9, to upper right column on page 144, last line | Lower right column on page 35, line 14, to upper left column on page 36, line 4 from the bottom | Page 64, lines 1 to 51 |
| Methods for the Dispersion of Photographically Useful Additives | Lower left column on page 144, line 1, to upper right column on page 146, line 7 | Lower right column on page 27, line 10, to upper left column on page 28, last line, and lower right column on page 35, line 12, to upper right column, page 36, line 7 | Page 63, line 51 to page 64, line 56 |

TABLE 3

| Photographic Structural Element | JP-A-62-215272 | JP-A-2-33144 | EP 0,355,660A2 |
|---|---|---|---|
| Film Hardening Agents | Upper right column on page 146, line 8, to lower left column on page 155, line 4 | — | — |
| Developing Agent Precursors | Lower left column on page 155, line 5, to lower right column on page 155, line 2 | — | — |
| Development Inhibitor Releasing Compounds | Lower right column on page 155, lines 3 to 9 | — | — |
| Supports | Lower right column on page 155, line 19, to upper left column on page 156, line 14 | Upper right column on page 38, line 18 to upper left column on page 39, line 3 | Page 66, line 29 to page 67, line 13 |
| Light-Sensitive Material Layer Structure | Upper left column on page 156, line 15, to lower right column on page 156, line 14 | Upper right column on page 28, lines 1 to 15 | Page 45, lines 41 to 52 |
| Dyes | Lower right column on page 156, line 15, to lower right column on page 184, last line | Upper left column on page 38, line 12, to upper right column on page 38, line 7 | Page 66, lines 18 to 22 |
| Anti-Color Mixing Agents | Upper left column on page 185, line 1, to lower right column on page 188, line 3 | Upper right column on page 36, lines 8 to 11 | Page 64, line 57 to page 65, line 1 |
| Gradation Control Agents | Lower right column on page 188, lines 4 to 8 | — | — |

TABLE 4

| Photographic Structural Element | JP-A-62-215272 | JP-A-2-33144 | EP 0,355,660A2 |
|---|---|---|---|
| Surfactants | Lower left column on page 201, line 1, to upper right column on page 210, last line | Upper right column on page 18, line 1, to lower right column on page 24, last line, and lower left column on page 27, line 10 from the bottom, to lower right column, line 9 | — |
| Fluorine Containing Compounds (Anti-static agents, coating aids, lubricants, adhesion preventive agents, etc.) | Lower left column on page 210, line 1, to lower left column on page 222, line 5 | Upper left column on page 25, line 1, to lower right column on page 27, line 9 | — |
| Binders (Hydrophilic colloids) | Lower left column on page 222, line 6, to upper left column on page 225, last line | Upper right column on page 38, lines 8 to 18 | Page 66, lines 23 to 28 |
| Thickeners | Upper right column on page 225, line 1, to upper right column on page 227, line 2 | — | — |
| Anti-static Agents | Upper right column on page 227, line 3, to upper left column on page 230, line 1 | — | — |
| Polymer Latexes | Upper left column on page 230, line 2, to page 239, last line | — | — |
| Matting Agents | Upper left column on page 240, line 1, to upper right column on page 240, last line | — | — |

TABLE 5

| Photographic Structural Element | JP-A-62-215272 | JP-A-2-33144 | EP 0,355,660A2 |
|---|---|---|---|
| Photographic Processing Methods (Processing operations additives, etc.) | Upper right column on page 3, line 7, to upper right column on page 10, line 5 | Upper left column on page 39, line 4, to upper left column on page 42, last line | Page 67, line 14, to page 69, line 28 |

NOTES

The citations from JP-A-62-215272 also include the details amended in accordance with the procedural amendment dated March 16, 1987, which is appended to the end of the specification. Furthermore, from among the color coupler, mentioned above, use of the so-called short wave-type yellow couplers disclosed in JP-A-63-231451, JP-A-63-123047, JP-A-63-241547, JP-A-1-173499, JP-A-1-213648 and JP-A-1-250944 as yellow couplers is desirable.

The cyan, magenta and yellow couplers are preferably impregnated into a loadable latex polymer in the presence (or absence) of a high boiling point organic solvent as disclosed in the aforementioned tables (for example, U.S. Pat. No. 4,203,716), or dissolved together with a polymer which is water insoluble and soluble in organic solvents, and emulsified and dispersed in an aqueous hydrophilic colloid solution. The homopolymers and copolymers disclosed from column 7 to column 15 of the specification of U.S. Pat. No. 4,857,449 and on pages 12–30 of the specification of International Patent laid open WO88/00723 can be cited as preferred water insoluble and organic solvent soluble polymers which can be used. The methacrylate-based or acrylamide-based polymers are preferred, and the use of acrylamide-based polymers is especially desirable in that it increases the colored image stability, for example.

Furthermore, use of the 3-hydroxypyridine-based cyan couplers disclosed in European Patent EP0,333,185A2 (from among these, the couplers which have been made into two-equivalent couplers by including a chlorine leaving group in the four-equivalent coupler (42) which is cited as an actual example, and the couplers (6) and (9), are especially desirable), the ring-like active methylene-based cyan couplers disclosed in JP-A-64-32260 (from among these, the couplers 3, 8 and 34 which are cited as actual examples are especially desirable), the pyrrolopyrazole-type cyan couplers disclosed in European Patent EP0456226A1, the pyrroloimidazole-type cyan couplers disclosed in European Patent EP0484909 and the pyrrolotriazole-type cyan couplers disclosed in European Patents EP0488248 and EP0491197A1, as well as the diphenylimidazole-based cyan couplers disclosed in JP-A-2-33144 for the cyan couplers, is desirable.

Furthermore, use of the acylacetamide-type yellow couplers which have a three- to five-membered ring-like structure on the acyl group disclosed in European Patent EP0447969A1, the malondianilide-type yellow couplers which have a ring structure disclosed in European Patent Ep0482552A1, and the acylacetamide-type yellow couplers which have a dioxan structure disclosed in U.S. Pat. No. 5,118,599, as well as the compounds disclosed in the aforementioned tables, as yellow couplers is desirable. From among these, the acylacetamide-type yellow couplers in which the acyl group is a 1-alkylcyclopropane-1-carbonyl group and the malondianilide-type yellow couplers in which one anilido group is constructed with an indoline ring are especially desirable. These couplers may be used individually or conjointly.

The use of 5-pyrazolone-based magenta couplers as couplers which can be used conjointly with the magenta couplers of the present invention is desirable.

As well as the methods disclosed in the aforementioned tables, the processing materials and processing methods disclosed from line 1 of the lower right column on page 26 to line 9 of the upper right column on page 34 of JP-A-2-207250 and from line 17 of the upper left column on page 5 to line 20 of the lower right column on page 18 of JP-A-4-97355 are desirable as methods for processing the color photographic materials of the present invention.

ILLUSTRATIVE EXAMPLES

The invention is described in practical terms below by means of illustrative examples, but the invention is not limited by these examples. Unless otherwise indicated, all parts, percents, ratios and the like are by weight.

EXAMPLE 1

Preparation of the Supports

The mixed composition of titanium oxide (KA-10 made by Titan Kogyo K.K.) and polyethylene or a polyester (limiting viscosity 6.5) synthesized by polycondensation from a dicarboxylic acid composition and ethylene glycol as shown in Table 6 was melted and mixed at 300° C. in a biaxial mixing extruding machine, and a laminating layer of a thickness 30 μm was formed on the surface of an original paper of a thickness 180 μm by melt extrusion from a T-die. A calcium carbonate-containing resin composition was formed as a laminating layer of a thickness 30 μm by melt extrusion at 300° C. on the other side. The resin surface on which the emulsion was to be coated on the side of the support on which the laminated layer had been established was subjected to a corona discharge, and then a coating liquid of which the formulation is indicated below was coated at a rate of 5 cc/m$^2$ and dried for 2 minutes at 80° C. to provide the supports A and B for photographic purposes.

| Under-layer Formulation | | |
|---|---|---|
| Compound ExU1 | 0.2 | grams |
| Compound ExU2 | 0.001 | gram |
| $H_2O$ | 35 | cc |
| Methanol | 65 | cc |
| Gelatin | 2 | grams |
| pH | 9.5 | |

TABLE 6

| | Type of Support | $TiO_2$ |
|---|---|---|
| A | Polyethylene | 15 wt. % |
| B | Polyester*1) (Terephthalic acid/isophthalic acid 90:10*2) and 1,2-diol) | 15 wt. % |

*1)Molecular weight about 40,000

*2)Mol ratio

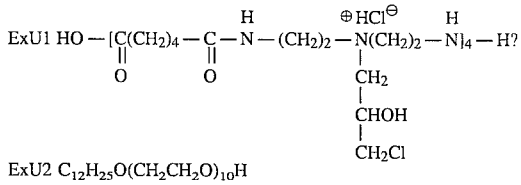

ExU2 $C_{12}H_{25}O(CH_2CH_2O)_{10}H$

The base paper was prepared using the method described below.

A mixed wood pulp (LBKP/NBSP=2/1) was beaten, and a pulp slurry of Canadian freeness 250 cc was formed. Next, after diluting this pulp slurry with water, with respect to the pulp, 1.0% of anionic polyacrylamide (made by Arakawa Kagaku Co., Polystron 195, molecular weight about 1,100,000), 1.0% of aluminum sulfate and 0.15% of polyamide polyamineepichlorhydrin (Kaimen 557; trade name of the Dick Hercules Co.) were added with stirring. Moreover, epoxidized behenic acid amide and alkylketene dimer (a compound with $C_{20}H_{41}$ alkyl groups) were each added in amounts of 0.4 percent by weight with respect to the weight of pulp, and then sodium hydroxide to adjust the pH to 7, 0.5% of cationic polyacrylamide and 0.1% of defoaming agent were added. The pulp slurry which had been prepared in this way was made into paper, such that the weight of the paper was 180 g/m$^2$.

The base paper which had been prepared in this way was dried in an oven to a moisture content of about 2%, and then an aqueous solution of which the formulation is indicated below was subjected to size-press (on the photographic emulsion coating side) as a surface sizing solution until the weight of liquid attached to the surface of the base paper was 20 g/m$^2$.

| | |
|---|---|
| Polyvinyl alcohol | 4.0% |
| Calcium chloride | 4.0% |
| Fluorescent whitener | 0.5% |
| Defoaming agent | 0.005% |

The thickness of the sized paper thus obtained was adjusted to 180 μm by machine calendering to form the base paper.

A multi-layer color printing paper (Sample 101) of which the layer structure is indicated below was prepared by coating the various photographic structural layers on the support A (a polyethylene-covered support) which had been prepared in this way. The coating liquids were prepared as indicated below.

Preparation of Coating Liquid

Ethyl acetate (50.0 cc) and 40.0 grams of solvent (Solv-2) were added to 23.0 grams of magenta coupler (ExM), and the solution thus obtained was added to 500 cc of a 20% aqueous gelatin solution which contained 8 cc of sodium dodecylbenzenesulfonate, after which an emulsified dispersion was prepared using an ultrasonic homogenizer. On the other hand, a silver chlorobromide emulsion (a 1:3 (silver mol ratio) mixture of a large size cubic emulsion of an average grain size 0.55 μm and a small size cubic emulsion of an average grain size 0.39 μm in which the variation coefficients of the grain size distributions were 0.10 and 0.08, respectively, and in each of which 0.8 mol. % AgBr was included locally on part of the grain surface) was prepared. The green sensitizing dye C indicated below was added to this emulsion in an amount of $4.0\times10^{-4}$ mol per mol of silver in the large size emulsion and $5.6\times10^{-4}$ mol per mol of silver in the small size emulsion, and the sensitizing dye D was added in an amount of $7.0\times10^{-5}$ mol per mol of silver in the large size emulsion and $1.0\times10^{-4}$ mol per mol of silver in the small size emulsion. Furthermore, the emulsion was chemically ripened with the addition of a sulfur sensitizer and gold sensitizer. The aforementioned emulsified dispersion was mixed with, and dissolved in, the green sensitive silver chlorobromide emulsion, and the third layer coating liquid was prepared so as to have the composition indicated below.

The coating liquid for the first, second, and fourth–seventh layers were also prepared using the same procedure as was used for the third layer coating liquid. H-1 and H-2 were used as gelatin hardening agents in each layer.

Furthermore, Cpd-10 and Cpd-11 were added to each layer in such a way that the total amounts were 25.0 mg/m$^2$ and 50.0 mg/m$^2$, respectively.

The spectral sensitizing dyes indicated below were used respectively in the silver chlorobromide emulsions of each light-sensitive emulsion layer.

TABLE 7

Blue Sensitive Emulsion Layer

Sensitizing Dye A

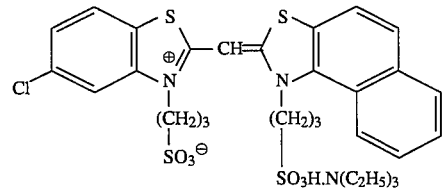

and

Sensitizing Dye B

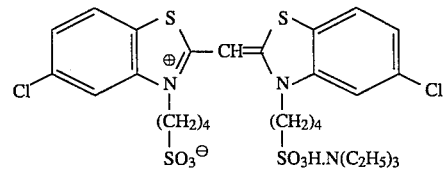

($2.0\times10^{-4}$ mol of each per mol of silver halide for the large size emulsion and $2.5\times10^{-4}$ mol of each per mol of silver halide for the small size emulsion)

TABLE 8

Green Sensitive Emulsion Layer

Sensitizing Dye C

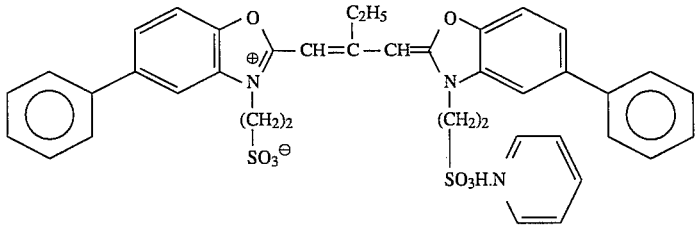

($4.0\times10^{-4}$ mol per mol of silver halide for the large

TABLE 8-continued

| Green Sensitive Emulsion Layer |
|---|
| size emulsion and $5.6 \times 10^{-4}$ mol per mol of silver halide for the small size emulsion) |
| Sensitizing Dye D |
| 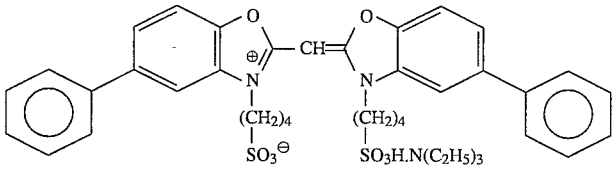 |
| ($7.0 \times 10^{-5}$ mol per mol of silver halide for the large size emulsion and $1.0 \times 10^{-4}$ mol per mol of silver halide for the small size emulsion) |

TABLE 9

| Red Sensitive Emulsion Layer |
|---|
| Sensitizing Dye E |
| ($0.9 \times 10^{-4}$ mol per mol of silver halide for the large size emulsion and $1.1 \times 10^{-4}$ mol per mol of silver halide for the small size emulsion) |
| 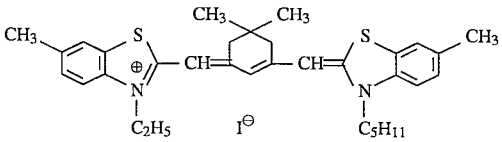 |
| Moreover, the compound indicated below was added in an amount of $2.6 \times 10^{-3}$ mol per mol of silver halide. |

TABLE 9-continued

| Red Sensitive Emulsion Layer |
|---|
| 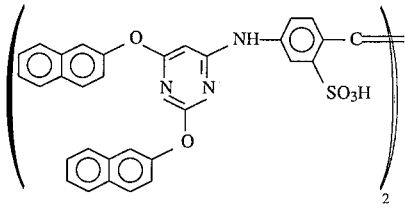 |

Furthermore, 1-(5-methylureidophenyl)-5-mercaptotetrazole was added to the blue, green and red sensitive emulsion layers in amounts, per mol of silver halide, of $8.5\times10^{-5}$ mol, $7.7\times10^{-4}$ mol and $2.5\times10^{-4}$ mol, respectively.

Furthermore, 4-hydroxy-6-methyl-1,3,3a, 7-tetraazaindene was added to the blue and green sensitive emulsion layers in amounts, per mol of silver halide, of $1\times10^{-4}$ mol and $2\times10^{-4}$ mol, respectively.

The dyes indicated below (coated weights in parentheses) were added to the emulsion layers for anti-irradiation purposes.

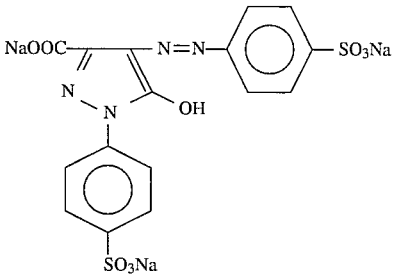

(10 mg/m²)

-continued

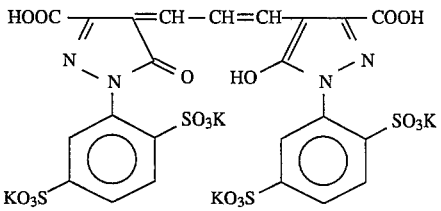

(10 mg/m²)

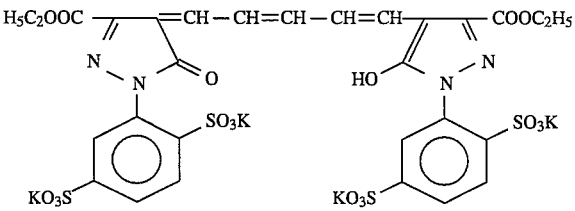

(40 mg/m²)

and

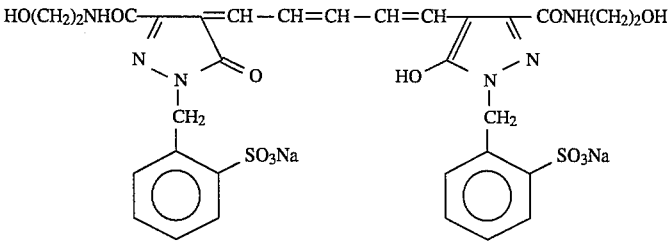

(20 mg/m²)

Layer Structure

The structure of each layer is indicated below. The numerical values indicate coated weights (g/m²). In the case of the silver halide emulsions, the coated weight is shown as the calculated coated weight of silver.

TABLE 10

| Support | |
|---|---|
| Polyethylene laminated paper [White pigment ($TiO_2$) and blue dye (ultramarine) were included in the polyethylene on the first layer side] | |
| **First Layer (Blue Sensitive Emulsion Layer)** | |
| Silver chlorobromide emulsion (a 3:7 (mol ratio) mixture of a large size cubic emulsion of an average grain size 0.88 μm and a small size cubic emulsion of an average grain size 0.70 μm; the variation coefficients of the grain size distributions were 0.08 and 0.10, respectively, and 0.3 mol % silver bromide was included locally on part of the grain surface with each size emulsion) | 0.26 |
| Gelatin | 1.52 |
| Yellow coupler (ExY) | 0.48 |
| Colored image stabilizer (Cpd-1) | 0.19 |
| Solvent (Solv-3) | 0.18 |
| Solvent (Solv-7) | 0.18 |
| Colored image stabilizer (Cpd-7) | 0.06 |
| Colored image stabilizer (Cpd-9) | 0.04 |
| Stabilizer (Cpd-12) | 0.01 |

TABLE 11

| Second Layer (Anti-Color Mixing Layer) | |
|---|---|
| Gelatin | 0.99 |
| Anti-color mixing agent (Cpd-5) | 0.08 |
| Solvent (Solv-10) | 0.03 |
| Solvent (Solv-1) | 0.16 |
| Solvent (Solv-4) | 0.16 |

TABLE 11-continued

| Third Layer (Green Sensitive Emulsion Layer) | |
|---|---|
| Silver chlorobromide emulsion (a 1:3 (mol ratio) mixture of a large size cubic emulsion of an average grain size 0.55 μm and a small size cubic emulsion of an average grain size 0.39 μm; the variation coefficients of the grain size distributions were 0.10 and 0.08, respectively, and 0.8 mol % AgBr was included locally on part of the grain surface with each size emulsion) | 0.12 |
| Gelatin | 1.24 |
| Magenta coupler (ExM) | 0.23 |
| Solvent (Solv-2) | 0.40 |

TABLE 12

| Fourth Layer (Ultraviolet Absorbing Layer) | |
|---|---|
| Gelatin | 0.70 |
| Solvent (Solv-4) | 0.11 |
| Anti-color mixing agent (Cpd-5) | 0.05 |
| Solvent (Solv-10) | 0.02 |
| Solvent (Solv-1) | 0.11 |
| **Fifth Layer (Red Sensitive Emulsion Layer)** | |
| Silver chlorobromide emulsion (a 1:4 (mol ratio) mixture of a large size cubic emulsion of an average grain size 0.58 μm and a small size cubic emulsion of an average grain size 0.45 μm; the variation coefficients of the grain size distributions were 0.09 and 0.11, respectively, and 0.6 mol % AgBr was included locally on part of the grain surface with each size emulsion) | 0.23 |
| Gelatin | 1.34 |
| Cyan coupler (ExC) | 0.32 |
| Colored image stabilizer (Cpd-2) | 0.03 |
| Colored image stabilizer (Cpd-4) | 0.02 |
| Colored image stabilizer (Cpd-6) | 0.18 |
| Colored image stabilizer (Cpd-7) | 0.40 |
| Colored image Stabilizer (Cpd-8) | 0.05 |
| Solvent (Soly-6) | 0.14 |

TABLE 13

| Sixth Layer (Ultraviolet Absorbing Layer) | |
|---|---|
| Gelatin | 0.53 |
| Ultraviolet absorber (UV-1) | 0.16 |
| Anti-color mixing agent (Cpd-5) | 0.02 |
| Solvent (Solv-5) | 0.08 |

TABLE 13-continued

| Seventh Layer (Protective Layer) | |
|---|---|
| Gelatin | 1.33 |
| Acrylic modified poly(vinyl alcohol) copolymer (degree of modification 17%) | 0.17 |
| Liquid paraffin | 0.03 |

(ExY) Yellow Coupler
A 1:1 (mol ratio) mixture of:

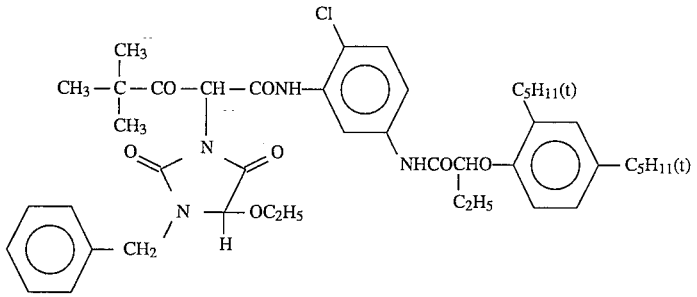

and

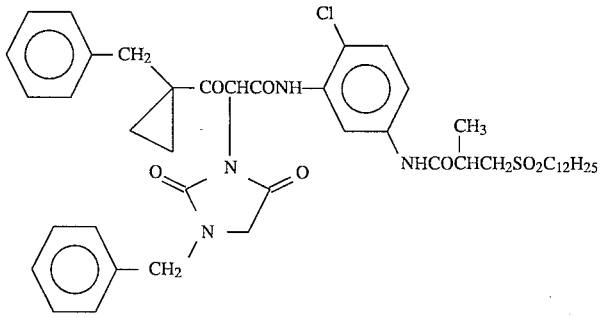

(ExM) Magenta Coupler

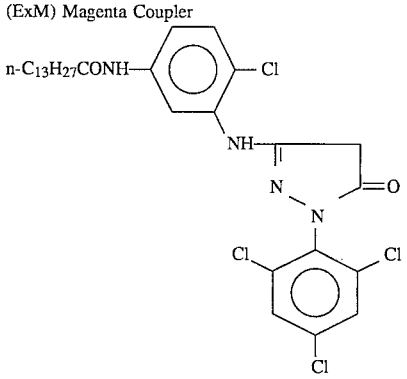

(ExC) Cyan Coupler
A 2:3:5 (mol ratio) mixture of:

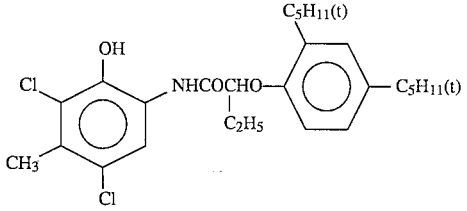

and

-continued
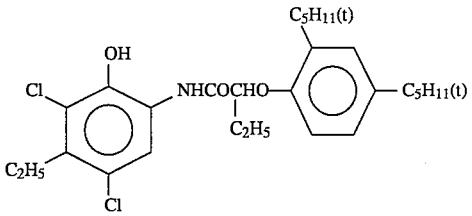
and
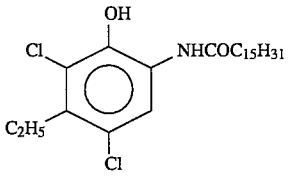
(Cpd-1) Colored Image Stabilizer
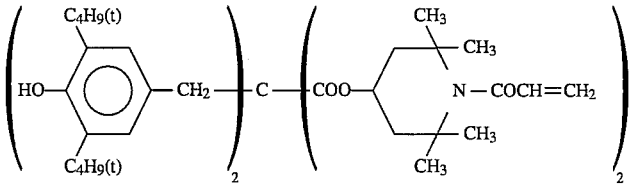
(Cpd-2) Colored Image Stabilizer
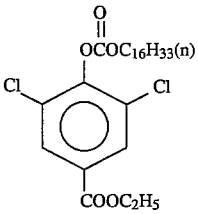
(Cpd-4) Colored Image Stabilizer
A 1:1 (mol ratio) mixture of:
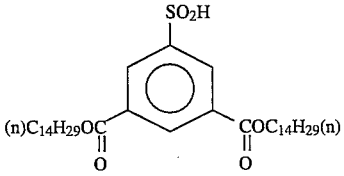
and
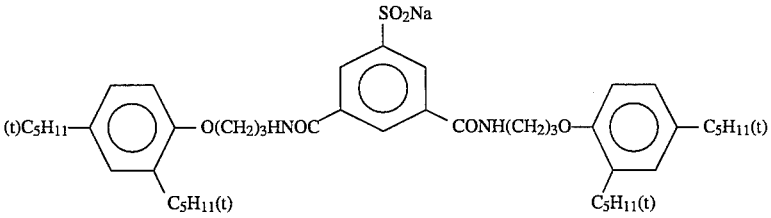
(Cpd-5) Anti-Color Mixing Agent
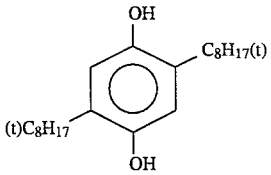
(Cpd-6) Colored Image Stabilizer -continued
A 2:4:4 (by weight) mixture of:
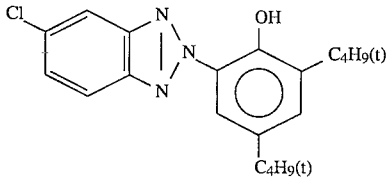
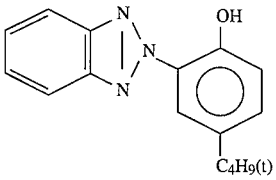
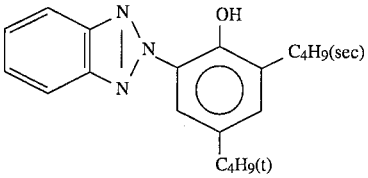
(Cpd-7) Colored Image Stabilizer
$-(CH_2CH)-$
$\quad\quad |$
$\quad\quad CONHC_4H_9(t)$ M.W. about 60,000
(Cpd-8) Colored Image Stabilizer
A 1:1 (by weight) mixture of:
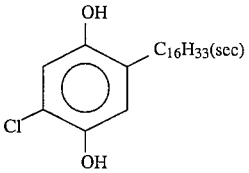
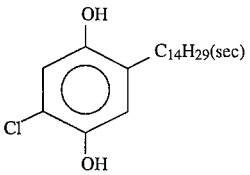
(Cpd-9) Colored Image Stabilizer
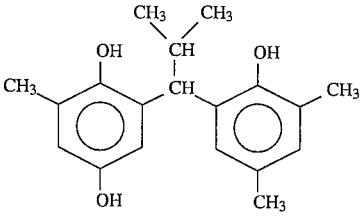
(Cpd-10) Fungicide
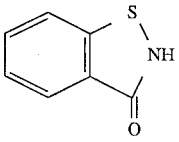
(Cpd-11) Fungicide
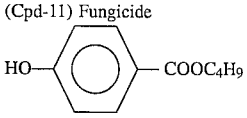
(Cpd-12) Stabilizer
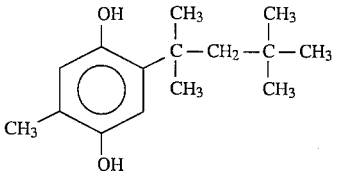

-continued
(UV-1) Ultraviolet Absorber
A 4:2:4 (by weight) mixture of:
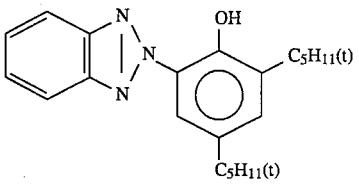
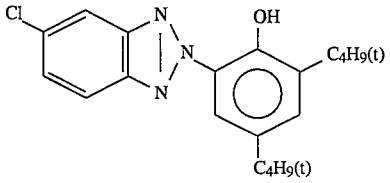
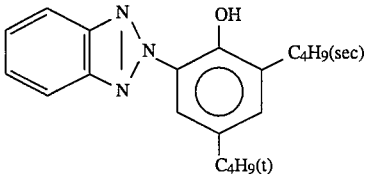
(H-1)
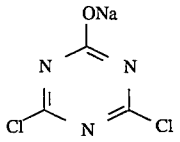
(H-2)
$CH_2{=}CH-SO_2-CH_2-CONH-CH_2$
$CH_2{=}CH-SO_2-CH_2-CONH-CH_2$
(Solv-1) Solvent
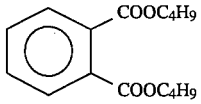
(Solv-2) Solvent
A 1:1 (by weight) mixture of:
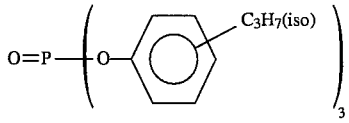
and
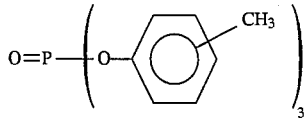
(Solv-3) Solvent
$O{=}P-(O-C_9H_{19}(iso))_3$
(Solv-4) Solvent
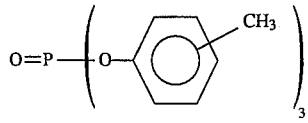

-continued (Solv-5) Solvent $COOC_8H_{17}$
|
$(CH_2)_8$
|
$COOC_8H_{17}$ (Solv-6) Solvent
An 80:20 (by volume) mixture of

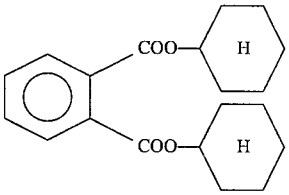

and $C_8H_{17}CHCH(CH_2)_7COOC_8H_{17}$
\ /
O (Solv-7) Solvent $C_8H_{17}CHCH(CH_2)_7COOC_8H_{17}$
\ /
O (Solv-10) Solvent

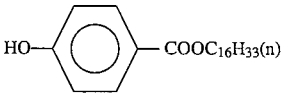

The multi-layer color photographic material prepared in this way was taken as Sample 101, and other samples (Samples 102–130) were prepared in just the same way as Sample 101 except that the support and the magenta coupler in the third layer were changed and compounds represented by general formulas (II), (IV), (V), (VI), (VII) and (VIII) were added, as shown in Table 14. The details are shown in Table 15.

TABLE 14

| | | | Colored Image Stabilizer | | | | Anti-staining Agent | | | | |
|---|---|---|---|---|---|---|---|---|---|---|---|
| Sample | Support | Magenta Coupler | Kind | Amount* (mol %) | Kind | Amount* (mol %) | Kind | Amount* (mol %) | Kind | Amount* (mol %) | Remarks |
| 101 | A | ExM | — | — | — | — | — | — | — | — | Comparison |
| 102 | " | " | (II-21) | 50 | — | — | — | | — | — | " |
| 103 | " | " | — | — | (B-2) | 20 | — | — | — | — | " |
| 104 | " | " | (II-21) | 50 | " | " | — | — | — | — | " |
| 105 | " | " | " | " | " | " | (VII-1) | 20 | (VIII-1) | 10 | " |
| 106 | " | I-47 | — | — | — | — | — | — | — | — | " |
| 107 | " | " | (II-21) | 50 | — | — | — | | — | — | " |
| 108 | " | " | — | — | (B-2) | 20 | — | — | — | — | " |
| 109 | " | " | (II-21) | 50 | " | " | — | — | — | — | " |
| 110 | " | " | " | " | " | " | (VII-1) | 20 | (VIII-1) | 10 | " |
| 111 | B | ExM | — | — | — | — | — | — | — | — | " |
| 112 | " | " | (II-21) | 50 | — | — | — | | — | — | " |
| 113 | " | " | — | — | (B-2) | 20 | — | — | — | — | " |
| 114 | " | " | (II-21) | 50 | " | " | — | — | — | — | " |
| 115 | " | " | " | " | " | " | (VII-1) | 20 | (VIII-1) | 10 | " |
| 116 | B | I-47 | — | — | — | — | — | — | — | — | Comparison |
| 117 | " | " | (II-21) | 50 | — | — | — | | — | — | " |
| 118 | " | " | — | — | (B-2) | 20 | — | — | — | — | " |
| 119 | " | " | (II-21) | 50 | " | " | — | — | — | — | " |
| 120 | " | " | " | " | " | " | (VII-1) | 20 | (VIII-1) | 10 | Invention |
| 121 | " | I-7 | " | " | " | " | " | " | " | " | " |
| 122 | " | I-51 | " | " | " | " | " | " | " | " | " |
| 123 | " | " | " | " | (B-21) | " | " | " | " | " | " |
| 124 | " | " | (A-1) | " | " | " | " | " | " | " | " |
| 125 | " | " | " | " | (H-2) | " | " | " | " | " | " |

TABLE 14-continued

| Sample | Support | Magenta Coupler | Colored Image Stabilizer Kind | Amount* (mol %) | Kind | Amount* (mol %) | Anti-staining Agent Kind | Amount* (mol %) | Kind | Amount* (mol %) | Remarks |
|---|---|---|---|---|---|---|---|---|---|---|---|
| 126 | " | " | " | " | (H-8) | " | " | " | " | " | " |
| 127 | " | I-21 | " | " | (B-21) | " | " | " | " | " | " |
| 128 | " | " | " | " | (H-2) | " | " | " | " | " | " |
| 129 | " | " | " | " | (H-8) | " | " | " | " | " | " |
| 130 | " | " | (II-21) | " | (B-2) | " | " | " | " | " | " |

*Amount added with respect to the magenta coupler.

A graded exposure through tri-color separation filters as used for sensitometric purposes was given to each sample obtained, using a sensitometer (Model FWH made by the Fuji Photo Film Co., Ltd., light source color temperature 3200° K.). The exposure at this time was made with an exposure of 250 CMS at an exposure time of 0.1 second.

The above-mentioned samples were processed using a paper processor with the processing operations and processing bath compositions indicated below.

| Processing Operation | Temperature (°C.) | Time (sec.) | Replenishment Rate* | Tank Capacity |
|---|---|---|---|---|
| Color Development | 35 | 45 | 161 ml | 10 liters |
| Bleach-fix | 35 | 45 | 218 ml | 10 liters |
| Rinse (1) | 35 | 30 | — | 5 liters |
| Rinse (2) | 35 | 30 | — | 5 liters |
| Rinse (3) | 35 | 30 | 360 ml | 5 liters |
| Drying | 80 | 60 | | |

*Replenishment rate per square meter of photographic material.
(A three tank counter flow system from Rinse (3) → Rinse (1) was used)

The composition of each processing bath was as follows:

| | Tank Solution | Replenisher |
|---|---|---|
| **Color Developer** | | |
| Water | 800 ml | 800 ml |
| Ethylenediamine tetra-acetic acid | 3.0 grams | 3.0 grams |
| 4,5-Dihydroxybenzene-1,3-di-sulfonic acid, di-sodium salt | 0.5 gram | 0.5 gram |
| Triethanolamine | 12.0 grams | 12.0 grams |
| Potassium chloride | 2.5 grams | — |
| Potassium bromide | 0.01 gram | — |
| Potassium carbonate | 27.0 grams | 27.0 grams |
| Fluorescent whitener (WHITEX 4B, made by Sumitomo Kagaku) | 1.0 gram | 2.5 grams |
| Sodium sulfite | 0.1 gram | 0.2 gram |
| Di-sodium-N,N-bis(sulfonato-ethyl)-hydroxylamine | 5.0 grams | 8.0 grams |
| N-Ethyl-N-(β-methanesulfon-amido-ethyl)-3-methyl-4-amino-aniline, 3/2 sulfate monohydrate | 5.0 grams | 7.1 grams |
| Water to make | 1000 ml | 1000 ml |
| pH (25° C./with potassium hydroxide and sulfuric acid) | 10.05 | 10.45 |
| **Bleach-Fixer (Tank Solution = Replenisher)** | | |
| Water | | 600 ml |
| Ammonium thiosulfate (700 grams/liter) | | 100 ml |
| Ammonium sulfite | | 40 grams |
| Ethylenediamine tetra-acetic acid, iron (III) ammonium salt | | 55 grams |
| Ethylenediamine tetra-acetic acid | | 5 grams |
| Ammonium bromide | | 40 grams |
| Nitric acid (67%) | | 30 grams |
| Water to make | | 1000 ml |

-continued

| | Tank Solution | Replenisher |
|---|---|---|
| pH (25° C./with acetic acid and aqueous ammonia) | | 5.8 |
| **Rinse Bath (Tank Solution = Replenisher)** | | |
| Chlorinated sodium isocyanurate | | 0.02 gram |
| De-ionized water (conductivity less than 5 μS/cm) | | 1000 ml |
| pH | | 6.5 |

Next, CTF values were measured by exposing the samples to green light using an optical wedge for CTF measurement purposes and processing in order to measure the sharpness of each sample.

A high degree of sharpness with little deterioration of contrast is indicated by a larger CTF value.

Next, the spectral reflection absorption spectra of the magenta parts of samples obtained by exposing the samples through an optical wedge with a light source to which a green filter had been fitted and carrying out development processing in the same way as before were measured (Shimadzu Photometer UV-365), and the density values at 430 nm when the absorption densities at 550 nm were set to 1.0 were investigated. From the results shown in Table 15, it is clear that the subsidiary absorbance at 430 nm of the magenta images obtained when couplers of the present invention were used was small and that there was little color stain when compared with that observed with the comparative coupler ExM (Samples 101–105, and Samples 111–115).

On the other hand, evaluation of the deterioration of the image parts and non-image parts with respect to storage under hot and humid conditions was carried out by first measuring the magenta reflection density at a yellow reflection density of 2.0 of the yellow image part and the yellow reflection density and the magenta density of the non-image part (white background part) 1 hour after the development processed sample had been processed and then measuring the reflection densities at the same points as were measured before in the yellow image part and the white background part after the samples had been left to stand for 16 days under conditions of 80° C. and 70% (RH), and obtaining the extent of the increases in the densities.

TABLE 15

| Sample | Magenta Density of Yellow Color Sample After Aging Under Hot Humid Conditions (Yellow Density After Processing 2.0) | Evaluation of Magenta Staining: Increase in Yellow Density | Evaluation of Magenta Staining: Increase in Magenta Density | Density at 430 nm of the Magenta Color When the Density at 550 nm was set to 1.0 | Resolving Power (50% CTF), Magenta | Remarks |
|---|---|---|---|---|---|---|
| 101 | 0.38 | 0.65 | 0.30 | 0.35 | 15 | Comparison |
| 102 | 0.39 | 0.63 | 0.27 | 0.36 | 15 | " |
| 103 | 0.39 | 0.52 | 0.22 | 0.36 | 14 | " |
| 104 | 0.38 | 0.45 | 0.15 | 0.35 | 15 | " |
| 105 | 0.39 | 0.43 | 0.13 | 0.36 | 14 | " |
| 106 | 0.30 | 0.22 | 0.09 | 0.20 | 15 | " |
| 107 | 0.33 | 0.22 | 0.08 | 0.19 | 15 | " |
| 108 | 0.30 | 0.20 | 0.07 | 0.19 | 15 | |
| 109 | 0.31 | 0.15 | 0.08 | 0.20 | 15 | " |
| 110 | 0.30 | 0.14 | 0.02 | 0.20 | 15 | " |
| 111 | 0.36 | 0.54 | 0.28 | 0.35 | 17 | " |
| 112 | 0.36 | 0.58 | 0.24 | 0.35 | 17 | " |
| 113 | 0.37 | 0.47 | 0.20 | 0.36 | 16 | " |
| 114 | 0.36 | 0.41 | 0.14 | 0.35 | 17 | " |
| 115 | 0.37 | 0.39 | 0.12 | 0.35 | 18 | " |
| 116 | 0.25 | 0.14 | 0.09 | 0.20 | 17 | Comparison |
| 117 | 0.26 | 0.14 | 0.10 | 0.19 | 17 | " |
| 118 | 0.25 | 0.13 | 0.09 | 0.19 | 18 | " |
| 119 | 0.24 | 0.12 | 0.09 | 0.20 | 17 | " |
| 120 | 0.25 | 0.13 | 0.02 | 0.19 | 18 | Invention |
| 121 | 0.24 | 0.13 | 0.02 | 0.16 | 18 | " |
| 122 | 0.21 | 0.08 | 0.01 | 0.20 | 17 | " |
| 123 | 0.20 | 0.08 | 0.01 | 0.20 | 17 | " |
| 124 | 0.19 | 0.07 | 0.01 | 0.21 | 18 | " |
| 125 | 0.20 | 0.08 | 0.01 | 0.21 | 17 | " |
| 126 | 0.20 | 0.08 | 0.01 | 0.21 | 17 | " |
| 127 | 0.19 | 0.06 | 0.01 | 0.23 | 18 | " |
| 128 | 0.20 | 0.07 | 0.02 | 0.22 | 18 | " |
| 129 | 0.20 | 0.10 | 0.02 | 0.24 | 17 | " |
| 130 | 0.20 | 0.10 | 0.02 | 0.25 | 18 | " |

It is clear from the results in Table 15 that the embodiments of the present invention (Samples 120–130) gave rise to little trouble with coloration of the white background and color mixing (the formation of a magenta color component) in the yellow image on storage under hot and humid conditions.

Furthermore, it is clear that the resolving power of the image was also improved. Visually, the samples in which the support B had been used were better with respect to gloss than the samples in which the support A had been used.

EXAMPLE 2

A light-sensitive material was prepared in the same way as in Example 1 except that the structure of the second–fourth layers was modified in the way indicated below, and then it was evaluated in the same way as before. The results obtained were the same as those obtained in Example 1.

| | ($g/m^2$) |
|---|---|
| Second Layer | |
| Gelatin | 0.99 |
| Cpd-A | 0.04 |
| Cpd-B | 0.04 |
| Solv-1 | 0.16 |
| Solv-4 | 0.16 |
| Solv-10 | 0.03 |
| Third Layer | |
| Silver chlorobromide emulsion | 0.12 |

-continued

| | ($g/m^2$) |
|---|---|
| (same as in Example 1) | |
| Magenta coupler (I-51) | 0.26 |
| Cpd-2 | 0.03 |
| Cpd-3 | 0.04 |
| Cpd-4 | 0.02 |
| Cpd-9 | 0.02 |
| Solv-8 | 0.30 |
| Solv-9 | 0.15 |
| Gelatin | 1.24 |
| Fourth Layer | |
| Gelatin | 0.70 |
| Cpd-A | 0.03 |
| Cpd-B | 0.03 |
| Solv-1 | 0.11 |
| Solv-4 | 0.11 |
| Solv-10 | 0.02 |

Cpd-A

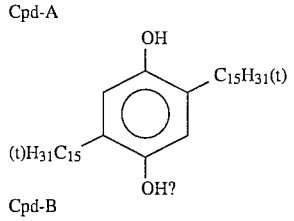

Cpd-B

-continued

| | (g/m²) |
|---|---|

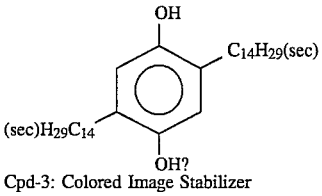

Cpd-3: Colored Image Stabilizer

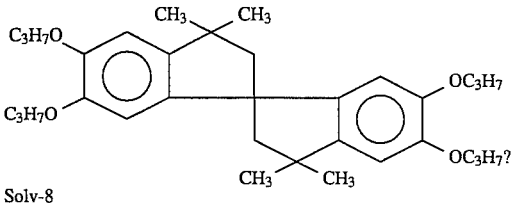

Solv-8

$O{=}P{+}O{-}C_6H_{13}(n))_3?$

Solv-9

$COOC_4H_9$
|
$(CH_2)_8?$
|
$COOC_4H_9$

EXAMPLE 3

Each of the photographic materials prepared in Example 1 was processed and evaluated in the same way as Example 1 except that the exposure indicated below was carried out. The results obtained were the same as in Example 1.

Furthermore, the exposure indicated below was carried out after storing the samples of the example for 10 days at 40° C. The extent of the decrease in photographic speed at this time was small in comparison to that observed in the comparative examples.

Exposure

Light of a 473 nm wavelength taken by wavelength conversion with a $KNbO_3$ SHG crystal from a YAG solid laser (oscillating wavelength: 946 nm) which had a GaAlAs semiconductor laser (oscillating wavelength: 808.5 nm) as an exciting light source, light of a 532 nm wavelength taken by wavelength conversion with a KTP SHG crystal from a $YVO_4$ solid laser (oscillating wavelength: 1064 nm) which had a GaAlAs semiconductor laser (oscillating wavelength: 808.7 nm) as an exciting light source and the light of a AlGaInP semiconductor laser (type number TOLD9211, made by Toshiba, oscillating wavelength: about 670 nm) were used as light sources. The apparatus was such that a sequential scanning exposure on the color printing paper was possible with the laser light which was being shifted in a direction perpendicular to the running direction by means of individual rotating multi-faceted bodies. The exposure was varied using this apparatus, and the relationship D—Log E between the density (D) of the photographic material and the exposure (E) was obtained. The laser light of the three wavelengths was modulated using external modulators, and the exposure was controlled in this way. The scanning exposure was carried out at 400 dpi, and the average exposure time per picture element at this time was about $5\times10^{-8}$ seconds. Peltier elements were used, and the temperatures of the semiconductor lasers were held constant in order to suppress the fluctuations in exposure due to the temperature.

Thus, with the present invention, the spectral absorption characteristics of the color forming dyes are excellent, and the image fastness and especially the color staining and change in color of the yellow dye image under conditions of high temperature and high humidity are improved.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a reflective support having thereon a yellow coupler-containing silver halide emulsion layer, a magenta coupler-containing silver halide emulsion layer, a cyan coupler-containing silver halide emulsion layer, and a light-insensitive hydrophilic colloid layer, wherein the yellow coupler-containing silver halide emulsion layer, the magenta coupler-containing silver halide emulsion layer, and the cyan coupler-containing silver halide emulsion layer have different color sensitivities from each other and are all coated on the same side of the support, wherein on at least the side of the support on which the emulsion layers are coated, the surface of the support is coated with a composition prepared by mixing and dispersing a white pigment in a resin comprising mainly polyester synthesized by the polycondensation of dicarboxylic acid and a diol, and at least one of the silver halide emulsion layers contains at least one coupler represented by formula (IIa), (IIb), (IIc), (IId) or (IIe), at least one compound represented by formula (III), (IV), (V) or (VI), and at least one compound represented by formula (VII) or (VIII):

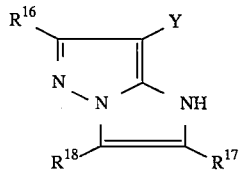

(IIa)

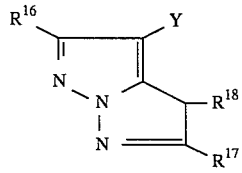

(IIb)

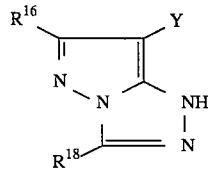

(IIc)

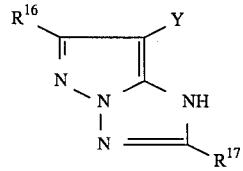

(IId)

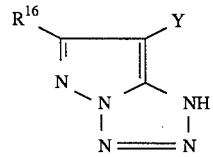

(IIe)

wherein $R^{16}$, $R^{17}$ and $R^{18}$ each represents an aliphatic group, an aromatic group, a heterocyclic group, RO—, RC(=O)—, RC(=O)O—, RS—, RSO—, $RSO_2$—, $RSO_2NH$—, RC(=O)NH—, RNH—, ROC(=O)NH—, (where R represents an alkyl group, an aryl group or a heterocyclic group), a hydrogen atom, a halogen atom, a cyano group, an imido group, a sulfamoyl group, a ureido group or a sulfamoylamino group, and Y represents a hydrogen atom or a group capable of splitting off upon a coupling reaction with an oxidation product of a developing agent, and dimers and polymers including oligomers may be formed with $R^{16}$ of formula (IIa), (IIb), (IIc), (IId) or (IIe), $R^{17}$ of formula (IIa), (IIb) or (IId), or $R^{18}$ of formula (IIa), (IIb) or (IIc), when $R^{16}$, $R^{17}$ or $R^{18}$ is not hydrogen, or with Y;

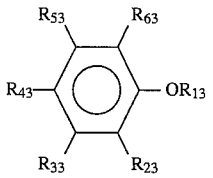

(III)

wherein $R_{13}$ represents a hydrogen atom, an alkyl group, an aryl group or a heterocyclic group, $R_{23}$, $R_{33}$, $R_{53}$ and $R_{63}$ each independently represent a hydrogen atom, a hydroxy group, an alkyl group, an aryl group or an alkoxy group, $R_{43}$ represents an alkyl group, a hydroxy group, an aryl group or an alkoxy group, and $R_{13}$ and $R_{23}$ may be joined together to form a five- or six-membered ring, or $R_{33}$ and $R_{43}$ may be joined together to form a five-membered hydrocarbyl ring;

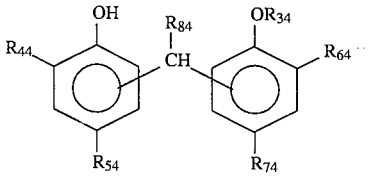

(IV)

wherein $R_{34}$ represents a hydrogen atom, an alkyl group, an acyl group, an aryl group or an alkenyl group, $R_{44}$, $R_{54}$, $R_{64}$ and $R_{74}$ each independently represents an alkyl group having 1 to 12 carbon atoms, $R_{84}$ represents a hydrogen atom or an alkyl group having 1 to 20 carbon atoms, the methine group which connects the two benzene rings connects the rings at the positions ortho or para to the oxygen atoms on the respective rings, and when connecting in the para positions, $R_{54}$ or $R_{74}$ represents the connecting methine group itself, and in this case there can be further alkyl groups on the benzene rings;

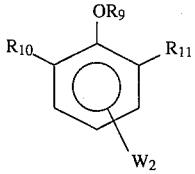

(V)

wherein $R_9$ represents a hydrogen atom, an alkyl group, an aryl group or an acyl group, $R_{10}$ and $R_{11}$ each independently represent an alkyl group or an alkoxy group, and $W_2$ represents a monovalent group selected from the group consisting of an alkoxycarbonyl group, an aryloxycarbonyl group, an alkyl group, a carbamoyl group and a sulfamoyl group;

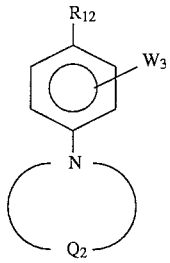

(VI)

wherein $Q_2$ is a divalent group which, together with alkylene groups and the nitrogen atom, forms a five- to seven-membered ring, with $Q_2$ representing a —$CH_2$—, —O—, —NR'—, —S—, —SO—, —$SO_2$, —PR'— or —PO(R')— group, wherein R' represents an alkyl group, $R_{12}$ represents an alkyl group, an alkoxy group, an aryloxy group or an acyloxy group, and $W_3$ represents a hydrogen atom or a monovalent group selected from the group consisting of an alkoxycarbonyl group, an aryloxycarbonyl group, an alkyl group, a carbamoyl group and a sulfamoyl group;

$$R_{21}—(A)_n—X \quad \text{(VII)}$$

wherein $R_{21}$ represents an aliphatic group, an aromatic group or a heterocyclic group, X represents a group which is eliminated on reaction with an aromatic amine developing agent, A represents a group which reacts with an aromatic amine developing agent and forms a chemical bond, and n represents 0 or 1;

$$R_{30}—Z \quad \text{(VIII)}$$

wherein $R_{30}$ represents an aliphatic group, an aromatic group or a heterocyclic group, and Z represents a nucleophilic group which contains an atom which bonds chemically directly with an oxidized form of an aromatic amine developing agent and which atom is an oxygen atom, a sulfur atom or a nitrogen atom, or a group which dissociates in the photographic material and releases a nucleophilic group; and wherein the compound represented by formula (VIII) is selected from the group consisting of an amine compound, an azide compound, a hydrazine compound, a mercapto compound, a sulfide compound, a sulfinic acid compound, a cyano compound, a thiocyano compound, a thiosulfate compound, a carboxyl compound, a hydroxamine acid compound, a phenol compound and a nitrogen heterocyclic compound; and wherein the silver halide emulsion layer which contains at least one coupler represented by Formula (IIa), (IIb), (IIc), (IId) or (IIe) comprises silver halide grains selected from silver chloride, silver chlorobromide or silver chloroiodobromide grains of which the silver chloride content is at least 95 mol % and the silver iodide content is not more than 1 mol %.

2. A silver halide color photographic material as in claim 1, wherein the polyester of the reflective support comprises mainly polyethylene terephthalate.

3. A silver halide color photographic material as in claim 1, wherein the dicarboxylic acid employed in the polycondensation is a mixture of terephthalic acid and isophthalic acid.

4. A silver halide color photographic material as in claim 1, wherein the dicarboxylic acid employed in the polycondensation is a mixture of terephthalic acid and naphthalenedicarboxylic acid.

5. A silver halide color photographic material as in claim 3, wherein the diol is ethylene glycol.

6. A silver halide color photographic material as in claim 4, wherein the diol is ethylene glycol.

7. A silver halide color photographic material as in claim 1, wherein the white pigment of the reflective support is titanium oxide and the weight ratio of titanium oxide to the resin comprising mainly polyester is from 5/95 (titanium oxide/resin) to 50/50.

8. A silver halide color photographic material as in claim 2, wherein the white pigment of the reflective support is titanium oxide and the weight ratio of titanium oxide to the resin comprising mainly polyester is from 5/95 (titanium oxide/resin) to 50/50.

9. A silver halide color photographic material as in claim 3, wherein the white pigment of the reflective support is titanium oxide and the weight ratio of titanium oxide to the resin comprising mainly polyester is from 5/95 (titanium oxide/resin) to 50/50.

10. A silver halide color photographic material as in claim 4, wherein the white pigment of the reflective support is titanium oxide and the weight ratio of titanium oxide to the resin comprising mainly polyester is from 5/95 (titanium oxide/resin) to 50/50.

11. A silver halide color photographic material as in claim 5, wherein the white pigment of the reflective support is titanium oxide and the weight ratio of titanium oxide to the resin comprising mainly polyester is from 5/95 (titanium oxide/resin) to 50/50.

12. A silver halide color photographic material as in claim 1, wherein the white pigment has a particle size of from 0.1 to 0.8 μm.

13. A silver halide color photographic material as in claim 1, wherein the white pigment is titanium dioxide.

14. A silver halide color photographic material as in claim 1, wherein the support has a center line average surface roughness $SR_a$ of not greater than 0.15 μm.

15. A silver halide color photographic material as in claim 1, wherein the coupler represented by formula (IIa), (IIb), (IIc), (IId) or (IIe) is a 1H-imidazo[1,2-b]pyrazole, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

16. A silver halide color photographic material as in claim 2, wherein the coupler of formula (IIa), (IIb), (IIc), (IId) or (IIe) is a 1H-imidazo[1,2-b]pyrazole, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

17. A silver halide color photographic material as in claim 3, wherein the coupler of formula (IIa), (IIb), (IIc), (IId) or (IIe) is a 1H-imidazo[1,2-b]pyrazolo, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

18. A silver halide color photographic material as in claim 4, wherein the coupler of formula (IIa), (IIb), (IIc), (IId) or (IIe) is a 1H-imidazo[1,2-b]pyrazole, a 1H-pyrazolo[5,1-c][1,2,4]triazole or a 1-pyrazolo[1,5-b][1,2,4]triazole, and the 2-position, 3-position or 6-position of the coupler is substituted with a branched alkyl group or an aryl group.

19. A silver halide color photographic material as in claim 5, wherein the coupler of formula (IIa), (IIb), (IIc), (IId) or (IIe) is a 1H-imidazo[1,2-b]pyrazole, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

20. A silver halide color photographic material as in claim 6, wherein the coupler of formula (IIa), (IIb), (IIc), (IId) or (IIe) is a 1H-imidazo[1,2-b]pyrazole, a 1H-pyrazolo[5,1-c][1,2,4]triazole or a 1H-pyrazolo[1,5-b][1,2,4]triazole, and the 2-position, 3-position or 6-position of the coupler is substituted with a branched alkyl group or an aryl group.

21. A silver halide color photographic material as in claim 1, wherein $R_{10}$ and $R_{11}$ are a substituted alkyl group or a substituted alkoxy group, wherein the substituent for the substituted alkyl group or substituted alkoxy group is an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic or aromatic sulfonyl group, an aliphatic or aromatic thio group, a hydroxy group, a cyano group, a carboxyl group, a nitro group, a sulfo group or a halogen atom.

* * * * *